United States Patent [19]

Munt, III

[11] Patent Number: 4,767,294

[45] Date of Patent: Aug. 30, 1988

[54] POWER CONVERSION DEVICE

[75] Inventor: Dean J. Munt, III, Santa Ana, Calif.

[73] Assignee: Pacific Power Systems, Inc., Estepona, Calif.

[21] Appl. No.: 63,805

[22] Filed: Jun. 24, 1987

Related U.S. Application Data

[63] Continuation-in-part of Ser. No. 919,247, filed as PCT US85/02590 on Dec. 31, 1985, published as WO86/04110, Jul. 17, 1986, abandoned, which is a continuation-in-part of Ser. No. 689,591, Jan. 7, 1985, abandoned.

[51] Int. Cl.[4] ..... F01B 7/20; F04B 19/02; F16K 3/00

[52] U.S. Cl. ..... 91/173; 92/177; 417/466; 137/625.2

[58] Field of Search ..... 91/173; 92/177, 248; 417/460, 466; 137/625.5, 625.2; 418/61 R, 186

[56] References Cited

U.S. PATENT DOCUMENTS

| | | | |
|---|---|---|---|
| 644,753 | 3/1900 | Allen | 91/173 |
| 1,554,756 | 9/1925 | Peters . | |
| 1,579,010 | 3/1926 | Levine | 92/177 |
| 1,598,653 | 9/1926 | Peters . | |
| 1,630,953 | 5/1927 | Levine | 92/177 |
| 1,998,441 | 4/1935 | Campbell . | |
| 3,567,349 | 3/1971 | Meulendyk | 418/61 R |
| 3,736,078 | 5/1973 | Read et al. | 418/61 R |
| 3,964,442 | 6/1976 | Hunter | 418/61 R |
| 4,253,806 | 3/1981 | D'Amato | 418/61 R |
| 4,597,403 | 7/1986 | Milburn, Jr. | 92/177 |

FOREIGN PATENT DOCUMENTS

| | | | |
|---|---|---|---|
| 590003 | 3/1934 | Fed. Rep. of Germany | 418/61 R |

*Primary Examiner*—John J. Vrablik
*Attorney, Agent, or Firm*—William P. Green

[57] ABSTRACT

A power conversion device which can efficiently convert between fluid pressure and rotary motion. The device includes a piston plate, which is surrounded by an array of pressure chambers and engageable with a shaft and its accompanying gear assembly. Manifold networks act as valves to control the sequential pressurization and depressurization of the pressure chambers so as to produce orbital movement of the piston plate about the shaft, as though it were floating on a cushion of air.

44 Claims, 9 Drawing Sheets

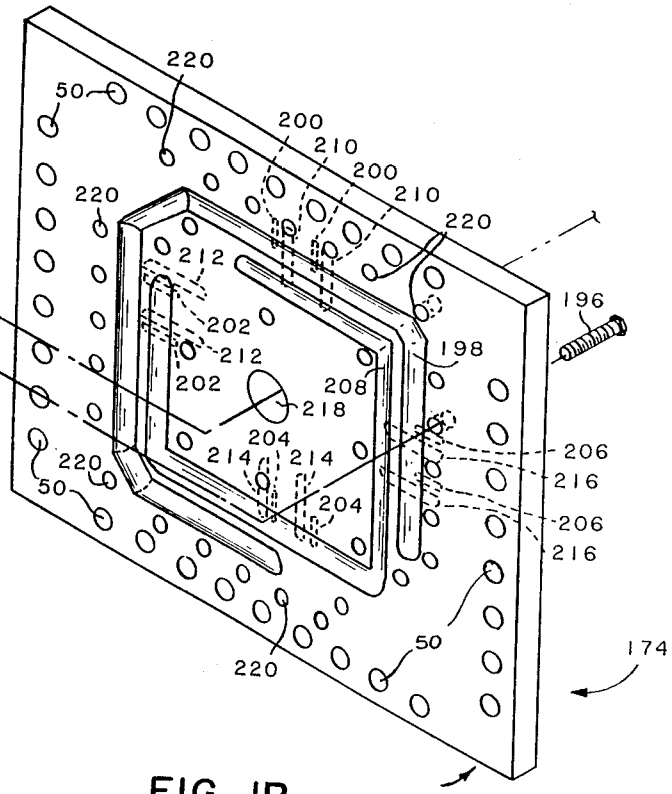
FIG. IB
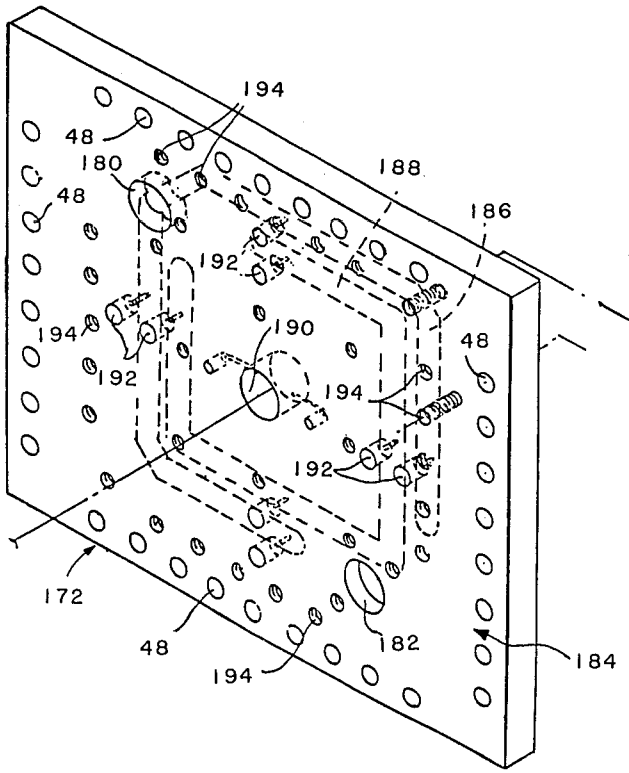
FIG. IA

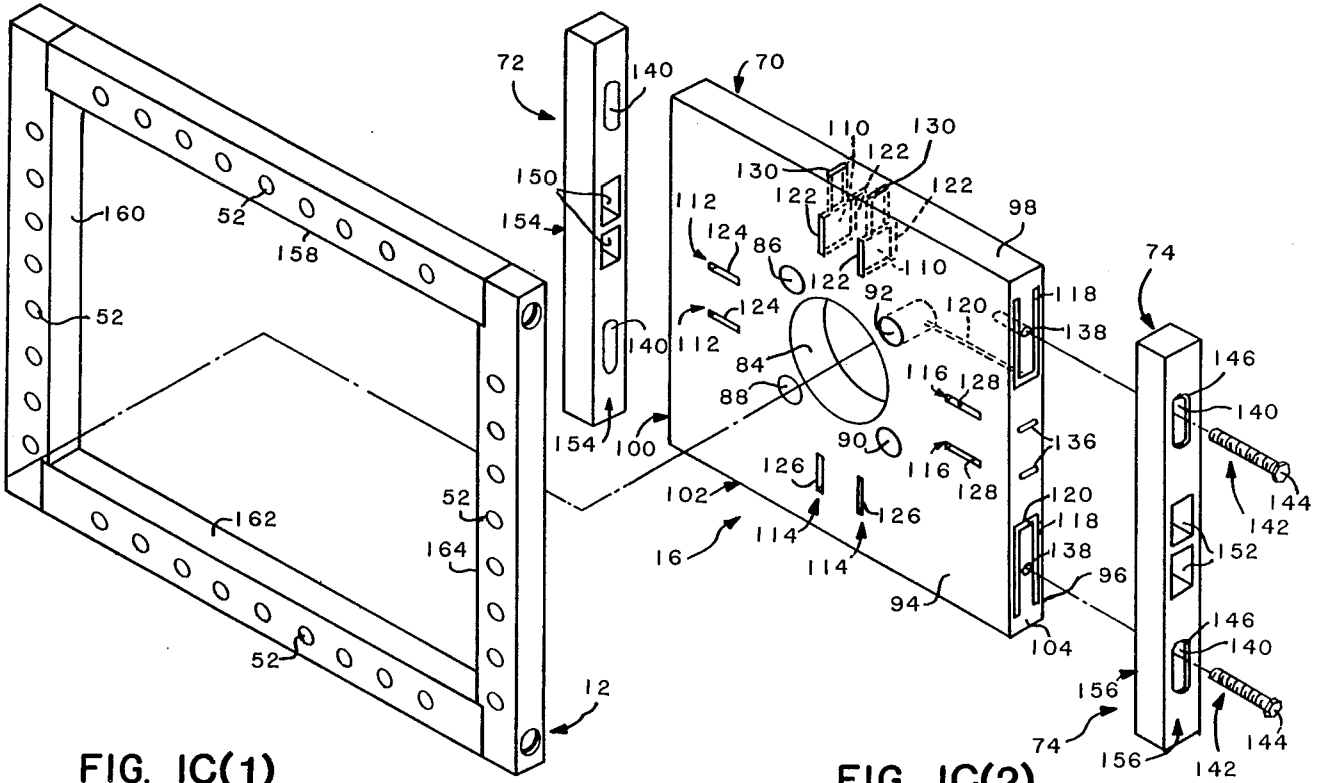
FIG. IC(2)
FIG. IC(1)

POWER CONVERSION DEVICE

This is a continuation-in-part of co-pending application Ser. No. 919,247 filed as PCT US85/02590 on Dec. 31, 1985, published as WO86/04110 Jul. 17, 1986, abandoned, which was the National Phase of International patent application No. PCT/US85/02590 filed Dec. 31, 1985, which was a continuation-in-part of U.S. patent application Ser. No. 689,591 filed Jan. 7, 1985 on "Orbital Power Conversion Device", abandoned.

FIELD OF THE INVENTION

This invention relates generally to power conversion devices, and more particularly, to devices for converting between fluid pressure and rotary motion.

BACKGROUND OF THE INVENTION

A great variety of engines, which convert fluid pressure into rotary motion of a drive shaft, and a great variety of pumps, which convert the rotary motion of a drive shaft into fluid pressure, are known. Many of these devices employ one or more reciprocating pistons to achieve the power conversion. Reciprocating pistons, however, have a number of disadvantages. They are, for example, characteristically bulky, prone to vibration problems and require a large amount of mechanical components, all of which tend to unnecessarily limit the rotational speed of the drive shaft and make the power conversion inefficient. Frictional losses are high.

In an effort to address the disadvantages stemming from reciprocating pistons, engines and pumps have been developed which use non-reciprocating, or rotary, members or a combination of reciprocating and rotary members instead of pistons. By way of example, forms of such devices are described in U.S. Pat. No. 4,174,195 to Lassota and U.S. Pat. No. 1,579,010 to Levine.

Such arrangements can result in a reduction in the size and bulk of the device. This tends to increase the efficiency of power conversion, since the device is now somewhat more light in weight relative to the amount of power or fluid pressure output. Even these devices, however, have significant drawbacks.

Relative to the amount of power or fluid pressure output, they are, for example, still bulky and heavy and rely upon large numbers of moving mechanical parts. They are, therefore, inefficient from a power conversion standpoint, prone to succumb to wear sooner than anticipated, and are costly to manufacture. Their size and bulk also limit the environments in which they can be utilized. Further inefficiency in power conversion also stems from vibration problems and the fact that fluid pressure acts upon relatively small surface areas of the members which are used in the devices. These devices are often not effectively reversible. That is, they cannot effectively operate alternatively as engines or as vacuum pumps.

Accordingly, it should be appreciated that there has existed a definite need for a power conversion device which is relatively inexpensive to manufacture, which experiences less vibration, which, relative to the amount of power or fluid pressure output, is less bulky, lightweight and has fewer moving parts, and which is capable of more efficiently converting between fluid pressure and rotary motion.

SUMMARY OF THE INVENTION

The present invention, which addresses the above need is embodied in a power conversion device for efficiently converting between fluid pressure and rotary motion. It can be used either as an engine or as a vacuum pump, is relatively lightweight and inexpensive to manufacture, uses only a relatively small number of moving parts and can produce a high degree of power or fluid pressure per unit weight of the device.

The device includes a piston plate, which is surrounded by an array of pressure chambers and engageable wth a shaft and its accompanying gear assembly, and valve means, which may be first and second manifold networks situated on opposite sides of the piston plate, that control the sequential pressurization and depressurization of the pressure chambers so as to produce orbital movement of the piston plate about the shaft. In the engine mode of operation, therefore, the sequential pressurization and depressurization of the pressure chambers produces orbital movement of the piston plate which in turn drives the shaft, thereby converting fluid pressure into rotary motion. Conversely, in the vacuum pump mode of operation the sequential pressurization and depressurization of the pressure chambers by the piston plate produces a supply of pressurized fluid as controlled by the manifold networks.

The device may also include one or more additional piston plates which cooperate with their corresponding pressure chambers and manifold networks and function similarly to the single piston plate device described above. If two piston plates are used, the second plate advantageously orbits substantially 180 degrees out of phase with respect to the orbit of the first plate.

The piston plate has two opposing piston plate faces and four elongated edges oriented substantially perpendicular to the piston plate faces. In engine mode it functions not only as an actuator of the shaft, but also as a valve component for regulating fluid flow between the pressure chambers and manifold networks. To that end, the piston plate faces function as seals that close off the manifold networks from pressurizing and depressurizing selected chambers at selected stages of the orbit of the piston plate. The piston plate can also include fluid passages which are adapted to direct fluid to and from particular pressure chambers in response to the position of the piston plate. Specifically, the fluid passages have substantially rectangular fluid ports disposed on the piston plate faces and facing the manifold networks and substantially rectangular elongated edge ports disposed on the elongated edges of the piston plate and facing selected chambers. The fluid passages can have a shape like the letter T which provides a tri-directional flow control valve system that permits fluid to enter or exit both piston plate faces substantially simultaneously to or from the manifold networks. This fluid flow characteristic prevents the piston plate from translating along the shaft or rocking about a radial axis through the shaft.

The piston plate may also be slidably connected on two of its opposing elongated edges to two piston sliders which are adapted to reciprocate in a direction substantially perpendicular to a transverse axis of the shaft. The sliders have ports which, at selected stages of the piston plate orbit, align with the elongated edge ports disposed on two opposing elongated edges, thereby permitting fluid to pass between their corresponding pressure chambers and the manifold networks. Conversely, when the slider ports become non-aligned with the above elongated edge ports, the elongated edges of the piston sliders close off any pressurized and depressurized fluid within selected pressure chambers.

An advantageous array of four pressure chambers can be formed by the cooperation of a housing, with the piston plate and the two piston sliders. The housing is a rectangular frame having four longitudinal edges and surrounding the piston plate and two piston sliders. A first chamber is formed by a portion of an upper longitudinal edge of the first housing, the opposing first elongated edge of the first plate and portions of the elongated edges of the two piston sliders. The second chamber is formed by a left longitudinal edge of the first housing, portions of the upper and lower longitudinal edges of the first housing and by the opposing elongated edge of one of the piston sliders. The third chamber is formed by a portion of the lower longitudinal edge of the first housing, the opposing elongated edge of the piston plate and portions of the elongated edges of the two piston sliders. Finally, the fourth chamber is formed by a right longitudinal edge of the first housing, portions of the upper and lower longitudinal edges of the first housing and the elongated edge of the other piston slider.

The shaft fits within a bore centrally disposed on the piston plate such that the piston plate is eccentrically oriented relative to a transverse axis through the shaft. The gear assembly of the device may include a drive gear mounted on the shaft and engageable with two or four timing gears having corresponding timing pins. In the event that four timing gears are used, they are preferably disposed substantially 90 degrees apart with respect to the above transverse axis and fit within four corresponding timing pin bores in the piston plate. On the other hand, where two timing gears are used, they may be disposed substantially diametrically opposite to one another with respect to the above transverse axis and fit within two corresponding timing pin bores in the piston plate.

The first manifold network may include first manifold and valve plates and the second manifold network may include second manifold and valve plates, which together provide a high speed valve for substantailly simultaneously passing pressurized and depressurized fluid. Both the first and second valve plates have valve plate intake and exhaust ports which are connected respectively to fluid intake and exhaust passages formed by the valve plates mating with their corresponding manifold plates. At selected stages of the piston plate's orbit, the fluid ports of selected fluid passages align substantially simultaneously and alternatively with selected first and second valve plate intake and exhaust ports. These alignments permit pressurized fluid to be supplied to selected pressure chambers or, alternatively, exhausted from selected pressure chambers. When, however, during selected stages of the orbit, selected fluid ports become non-aligned with selected first and second valve plate intake and exhaust ports, the piston plate faces close off the passage of fluid between such fluid ports and intake and exhaust ports.

In the engine mode, the first and second valve plate intake ports are substantially rectangular, while the valve plate exhaust ports are, elongated with one flat side and one side having rounded ends. In vacuum pump mode the shape of first and second valve plate intake ports is similar to that of the first and second valve plate exhaust ports.

A substantial part of the device, such as the piston plate and the two piston sliders, can be made out of plastic. Consequently, it is more lightweight and less expensive to manufacture.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENTS

Figures 1D, 1E:
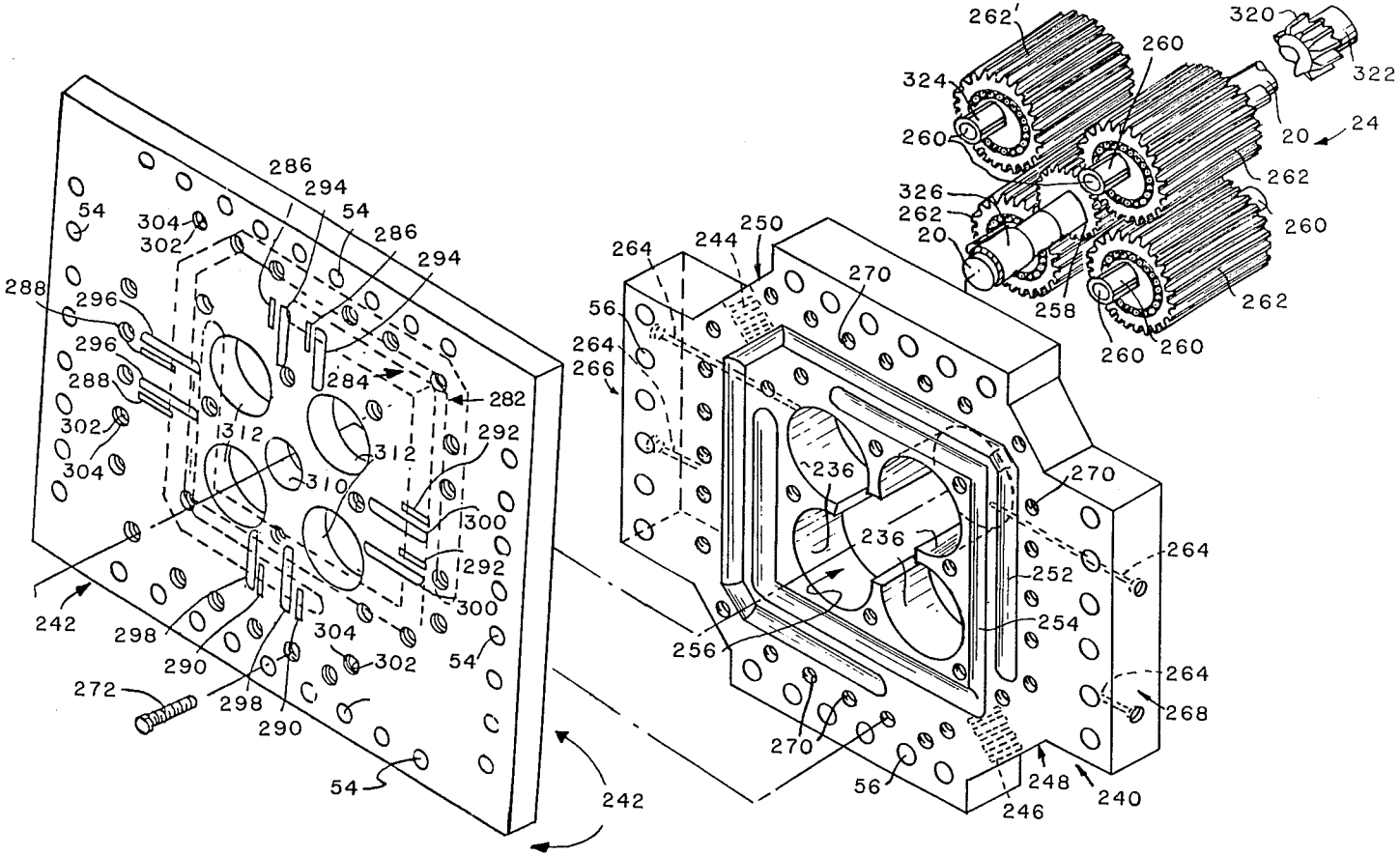
FIG. 1, consisting of FIGS. 1A–1E, is an exploded perspective view of a power conversion device according to the present invention.

A reversible power conversion device 10, for converting fluid pressure into rotary motion of a drive shaft and, conversely, for converting the rotary motion of a drive shaft into fluid pressure, is illustrated in FIGS. 1–6 of the accompanying drawings. As shown in FIGS. 1–5, the device 10 includes first and second housings 12 and 14 which, respectively, surround first and second power conversion piston assemblies 16 and 18 that are engageable with a shaft 20 and its accompanying gear assembly 24. The first piston assembly 16 is shown in FIG. 1C(2) and the second piston assembly 18, is simply similar in structure to the first piston assembly 16. Both the first and second piston assemblies 16 and 18 are partially shown in FIGS. 4 and 5. It will be understood that the device 10 of this embodiment uses two cooperating piston assemblies 16 and 18, but the invention can be practiced using only a single piston assembly or more than two such assemblies.

Figure 4:
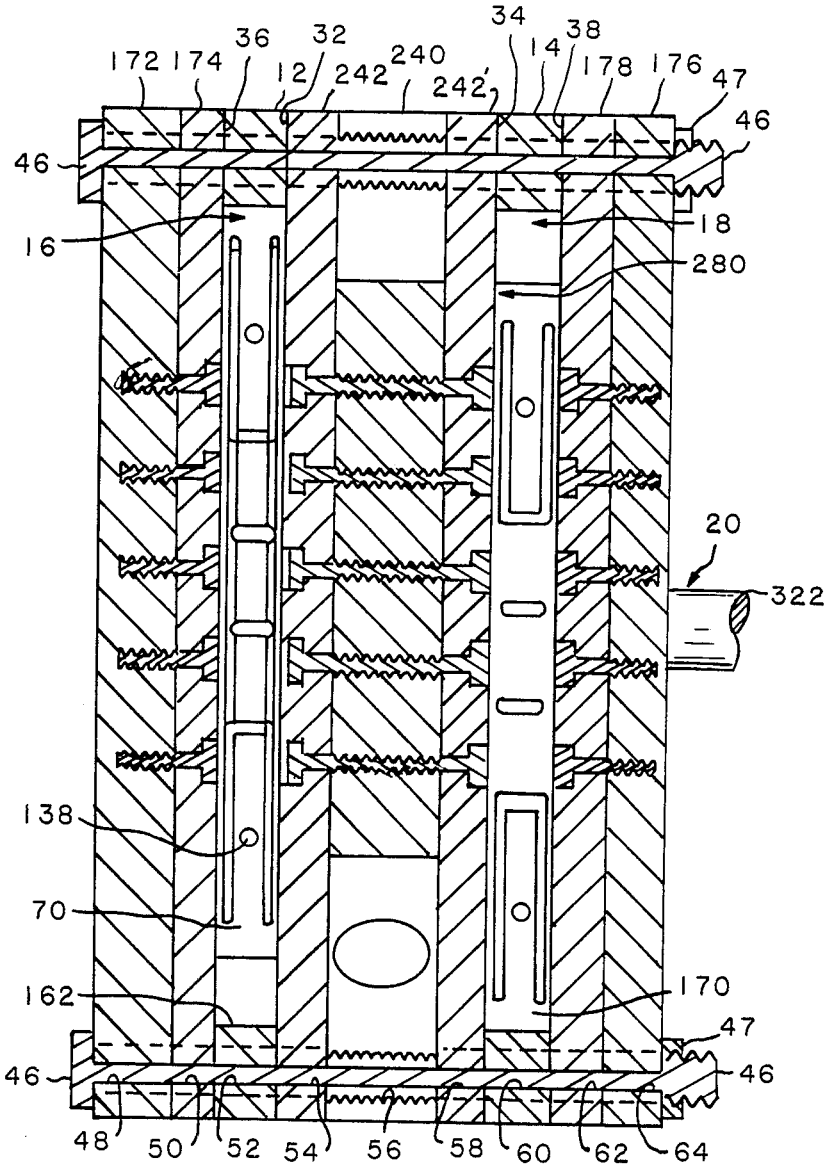
FIG. 4 is a sectional, elevational view of the power conversion device taken as indicated by line 4—4 in FIG. 3.
Figure 5:
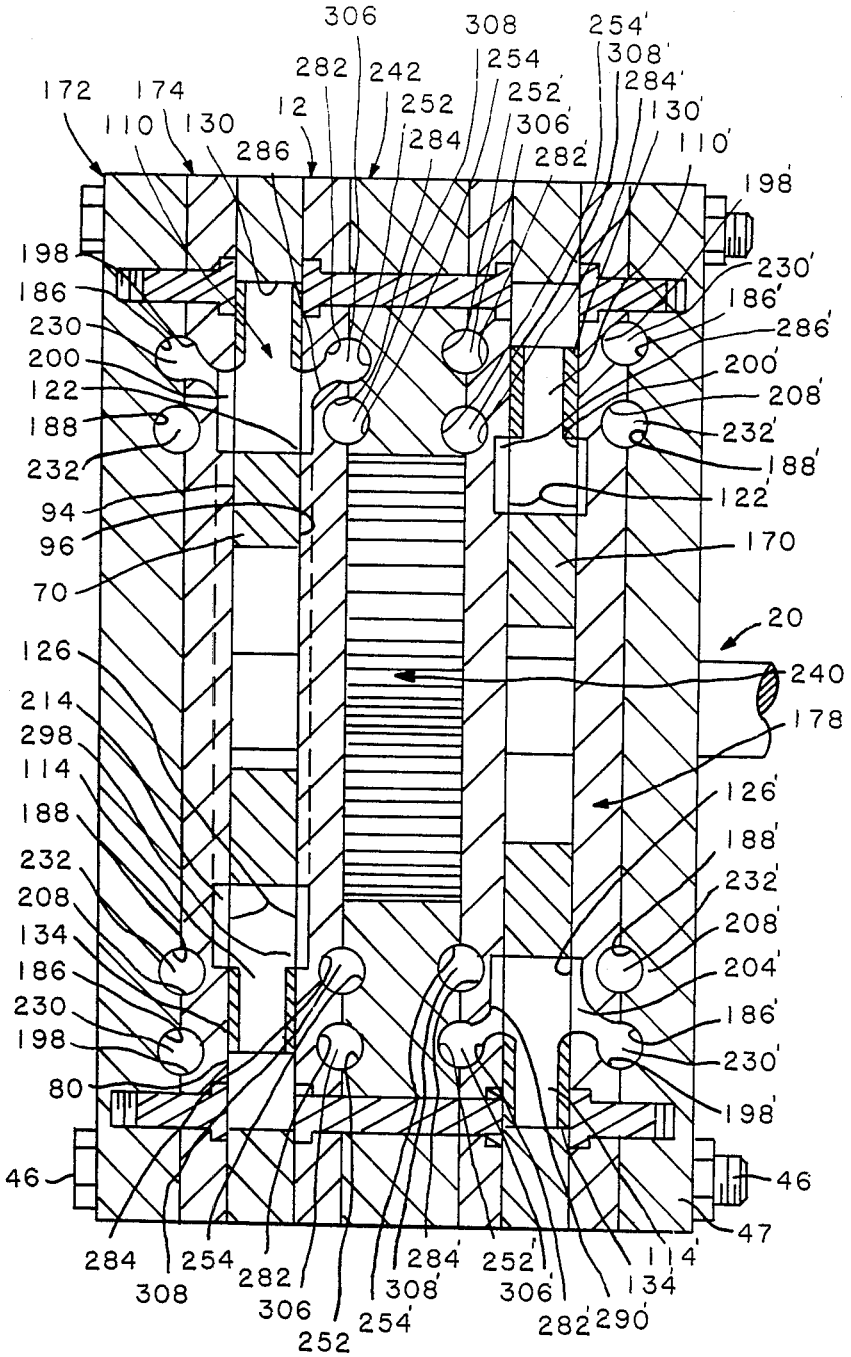
FIG. 5 is a sectional, elevational view of the power conversion device taken as indicated by line 5—5 in FIG. 3.

As shown in FIGS. 4–5, the first and second housings 12 and 14 are rectangular frames having inner faces 32 and 34 respectively and outer faces 36 and 38 respectively. They are separated from each other by a second manifold network 30 which is flush with the respective inner faces 32 and 34 of the first and second housings 12 and 14. Moreover, first and third manifold networks 40 and 42 are connected flush with respective outer faces 36 and 38. The first and second manifold networks 40 and 30 function as valves which simultaneously regulate the supply of pressurized fluid and the exhausting of depressurized fluid to the first piston assembly 16, while the second and third manifold networks 30 and 42 function in similar fashion for the second piston assembly 18.

The first manifold network is shown in FIGS. 1A and 1B and is similar in structure to the third manifold network.

As shown in FIG. 4, the first and second housings 12 and 14 and first through third manifold networks 40, 30 and 42 are connected to one another by bolts 46 having ends on which nuts 47 are threaded. The bolts 46 extend axially through coaxial bores 48 and 50 in the first manifold network 40, bores 52 in the first housing, bores 54, 56 and 58 in the second manifold network 30, bores 60 in the second housing 14, and bores 62 and 64 in the third manifold network 42, all of which are advantageously unthreaded. As shown in FIGS. 1 and 4, the shaft 20 extends axially through bores which are centrally disposed in the first and second piston assemblies 16 and 18 and first through third manifold networks 40, 30 and 32.

In the engine mode of operation, fluid pressure controlled by the first, second and third manifold networks 40, 30 and 32 actuates the first and second piston assemblies 16 and 18 which in turn drive the shaft 20, thereby converting fluid pressure into rotary motion. Conversely, in reverse or vacuum pump mode, the shaft 20 drives the first and second piston assemblies 16 and 18, thereby producing a supply of pressurized fluid as regulated by the manifold networks 40, 30 and 32.

In accordance with one aspect of the present invention, the first piston assembly 16 includes a first piston plate 70, shown in FIG. 1C(2), which is slidably connected to two first piston sliders 72 and 74. The first piston plate 70 and the two first piston sliders 72 and 74 fit within the first housing 12 and cooperate with it to form an array of four first fluid pressure chambers 76, 78, 80, and 82, shown in FIG. 3, which have their fluid supply and fluid disposal regulated by the first and second manifold networks 40 and 30. (See FIG. 3.)

The first piston plate 70 includes a first central bore 84 that is disposed within the first piston plate 70 and receives the shaft 20 such that the first piston plate 70 is eccentrically oriented about the shaft 20 and may execute orbital movement about it. Two, but preferably four, timing pin bores 86, 88, 90, and 92 which are symmetrically oriented relative to the transverse axis of the shaft 20 and adapted to receive part of the gear assembly 24 may also be included.

The surfaces of the first piston plate 70 define two relatively smooth, piston plate faces 94 and 96 and four relatively smooth, elongated edges 98, 100, 102 and 104 oriented perpendicular to the piston plate faces 94 and 96. The interior of the first piston plate 70 has four separate fluid passages 110, 112, 114 and 116 which are symmetrically disposed about the transverse axis of the shaft 20 but at a greater distance radially from the shaft 20 than the timing pin bores 86, 88, 90 and 92. Lubrication channels 118 disposed within the elongated edges 100 and 104 and having lubrication bores 120 may also be provided for lubricating the timing pin bores 86, 88, 90 and 92.

The plate faces 94 and 96 are substantially flush respectively with the first and second manifold networks 40 and 30. At selected stages of the first piston plate's 70 orbit about the shaft 20, they function as seals which close off the passage of fluid between the first and second manifold networks 40 and 30 and selected first chambers through selected first passages.

The fluid passages 110, 112, 114 and 116 have fluid ports 122, 124, 126 and 128 respectively and elongated ports 130, 132, 134 and 136 respectively. (Elongated edge ports 132 and 134, while not shown in FIG. 1C(2), have positions which correspond to elongated edge ports 130 and 136 respectively.) The fluid ports 122, 124, 126 and 128 are disposed on the plate faces 94 and 96 and face the first and second manifold networks 40 and 30. The elongated edge ports 130, 132, 134 and 136 are disposed respectively on the elongated edges 98, 100, 102 and 104 of first piston plate 70 and face respectively first chambers 76, 78, 80 and 82. As shown in FIG. 1C(2) both fluid ports 122, 124, 126 and 128 and the elongated edge ports 130, 132, 134 and 136 are advantageously rectangular in shape. They may, however, have somewhat curved shorter sides. The rectangular configuration tends to increase the efficiency of fluid transfer by providing for a lower pressure drop through the fluid passages 110, 112, 114 and 116 and a more rapid opening and closing of the fluid passages 110, 112, 114 and 116.

At selected stages of the orbit of the first piston plate 70 about the shaft 20, the fluid passages 110, 112, 114 and 116 function as conduits which direct fluid between the first and second manifold networks 40 and 30 and selected pressure chambers that correspond to the fluid passages 110, 112, 114 and 116 as stated above. The fluid passages 110, 112, 114 and 116 also provide for a tri-directional flow control valve system which permits the first piston plate 70 to execute a more energy-efficient orbit about the shaft 20, control the pressurization and depressurization of their corresponding first chambers 76, 78, 80 and 82 and tend to extend its useful and operating life.

More particularly, as shown in FIG. 1C(2) the fluid passages 110, 112, 114 and 116 advantageously have the configuration of a modified letter "T" which, in conjunction with the location of the fluid ports 122, 124, 126 and 128 and elongated edge ports 130, 132, 134 and 136 respectively, permits fluid to enter or exit simultaneously from the first and second manifold networks 40 and 30 through the fluid ports of selected fluid passages. For example, when at a selected stage in the orbit of the first plate 70 the first chamber 76 is to be pressurized, pressurized fluid from the first and second manifold networks 40 and 30 enters the fluid passage 110 simultaneously through the piston plate faces 94 and 96, and is directed into the first chamber 76 through the elongated edge ports 130. This fluid flow characteristic prevents the first piston plate 70 from translating along the shaft 20, from rocking about a radial axis through the shaft 20 or from abrading against the interior of the first housing 12. Consequently, the first piston plate 70 can execute an orbital movement about the shaft 20, as though it were floating on a cushion of air.

For the purpose of slidably connecting the first piston plate 70 to the first sliders 72 and 74 along the elongated edges 100 and 104, the first piston plate 70 and the two first sliders 72 and 74 have respectively slider attachment bores 138 and elongated slider bores 140, both of which receive threaded bolts 142 having heads 144. Specifically, the slider attachment bores 138 have their openings disposed on the upper and lower portions of the elongated edges 100 and 104. The elongated slider bores 140 have counterbores 146 which the heads 144 of the threaded bolts 142 securely abut and occupy corresponding upper and lower portions of the two first sliders 72 and 74. The threaded bolts 142 are inserted through the elongated slider bores 140 and threaded into the first slider attachment bores 138. Alternatively, the elongated slider bores 140 may also be dove tail slots.

As the first piston plate 70 orbits the shaft 20 and begins to slide relative to the two first sliders 72 and 74, the threaded bolts 142 slide back and forth within their corresponding elongated slider bores 140. Concurrently, the two first piston sliders and 72 and 74 reciprocate in a direction perpendicular to a transverse axis of the shaft 20.

The two first piston sliders 72 and 74 also regulate the supply of pressurized fluid to the first chambers 78 and 82, or, alternatively the exhausting of depressurized or spent fluid from them. More particularly, the two first sliders 72 and 74 have slider ports 150 and 152 disposed intermediate the elongated slider bores 140 and facing respectively the elongated edges 100 and 104 of the first piston plate 70. At various stages of the orbit of the first piston plate 70, and its accompanying sliding relative to the two first sliders 72 and 74, the slider ports 150 and 152 become simultaneously aligned with the elongated edge ports 132 and 136 respectively. These alignments permit fluid to be transferred between the first and second manifold networks 40 and 30 and the first chambers 78 and 82 through the fluid passages 124 and 128 respectively. Conversely, during periods of non-alignment, the elongated edges 154 and 156 of the two first sliders 72 and 74 act as seals which close off fluid flow between the first chambers 78 and 82 and the first and second manifold networks 40 and 30.

As shown in FIGS. 1C(1), 1C(2) and 3, the array of rectangular first chambers 76, 78, 80 and 82 is formed by the cooperation of the first housing 12, the first piston plate 70 and the two first piston sliders 72 and 74. More particularly, the first chamber 76 is formed by a portion of a longitudinal edge 158 of the first housing 12, the opposing elongated edge 98 of the first piston plate 70, and portions of the elongated edges 154 and 156 of the two first piston sliders 72 and 74. The first chamber 78 is formed by a longitudinal edge 160 of the first housing 12, portions of the longitudinal edges 158 and 162 of the first housing 12 and by the elongated edge 154 of the first piston slider 72. The first chamber 80 is formed by a portion of the longitudinal edge 162 of the first housing 12, the elongated edge 102 of the first piston plate 70 and portions of the elongated edges 154 and 156 of the two first piston sliders 72 and 74. Finally, the pressure chamber 82 is formed by a longitudinal edge 164 of the first housing 12, portions of the longitudinal edges 158 and 162 and the elongated edge 156 of the first piston slider 74.

As the first piston plate 70 orbits about the shaft and the two first sliders 72 and 74 reciprocate in a direction perpendicular to a transverse axis of the shaft 20, it will be appreciated that the volume of the first chambers 76, 78, 80 and 82 changes and the first chambers 76, 78, 80 and 82 become sequentially and cyclically pressurized with fluid and depressurized of spent fluid. For example, in engine mode the first chambers 76 reach minimum volume just as pressurization commences and reach maximum volume just as depressurization commences.

The sequential and cyclical pressurization and depressurization advantageously occur in accordance in the following four-part sequence:

| PRESSURIZATION | DEPRESSURIZATION | FLUID SEALED OFF |
|---|---|---|
| first chamber 76 | first chamber 80 | first chambers 78 and 82 sealed off by elongated edges 154 and 156 of the two first piston sliders 72 and 74 respectively and by the piston plate faces 94 and 96. |
| first chamber 78 | first chamber 82 | first chambers 76 and 80 sealed off by piston plate faces 94 and 96. |
| first chamber 80 | first chamber 76 | first chambers 78 and 82 sealed off by the elongated edges 154 and 156 of the two first piston sliders 72 and 74 respectively and by the piston plate faces 94 and 96. |
| first chamber 82 | first chamber 78 | first chambers 76 and 80 sealed off by piston plate faces 94 and 96. |

It will be appreciated that the second piston, assembly 18, surrounded by the second housing 14 as shown in FIG. 4, has constituent parts which are similar to those described above for the first piston assembly 16. As such, it includes a second piston plate 170, partially shown in FIGS. 4 and 5, which is slidably connected to two second piston sliders (not shown). The second piston plate 170 and its two second piston sliders are surrounded by the second housing 14 and cooperate with it to form an array of four second fluid pressure chambers that have their fluid supply and fluid disposal regulated by the second and third manifold networks 30 and 42.

The second piston assembly 18 and the second fluid pressure chambers function similarly, except that the second piston plate preferably orbits the shaft 20, 180 degrees out of phase with the orbit of the first piston plate 70. This feature makes the device more balanced during operation.

In accordance with another aspect of the invention, the first and second manifold networks 40 and 30 function as valves which simultaneously regulate the supply of pressurized fluid and the exhausting of depressurized fluid to the first piston assembly 16, while the second and third manifold networks 30 and 42 function in similar fashion for the second piston assembly 18.

Figure 2:
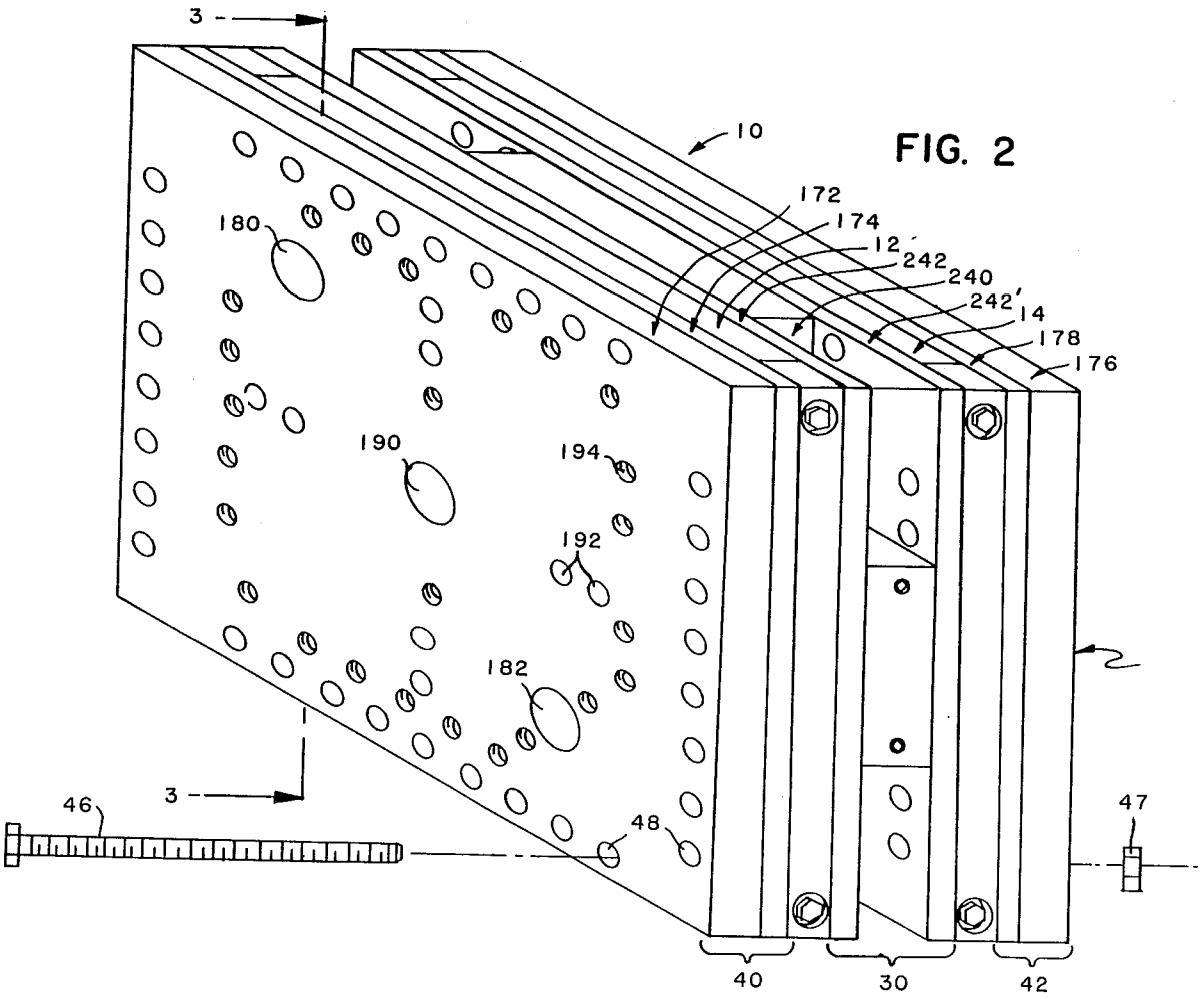
FIG. 2 is a perspective view of the power conversion device of FIG. 1 when assembled.

More particularly, as shown in FIGS. 2, 4 and 5 the first and third manifold networks 40 and 42 include flush first manifold and valve plates 172 and 174 and third manifold and valve plates 176 and 178 respectively. It will be appreciated that the first and third manifold networks 40 and 42 are similar in construction and operation. Therefore, the following description of the first manifold network 40 will correspond to a description of the third manifold, network 42, and corresponding components of the third manifold are designated by prime numerals (see FIG. 5).

As shown in FIGS. 1(A) and (B), the first manifold plate 172 of the first manifold network 40 includes a first manifold intake port 180 and a first manifold exhaust port 182. The first manifold intake port 180 is disposed on the front face 184 of the first manifold plate 172 and is adapted to receive pressurized fluid from a fluid source. It is further connected to a first manifold intake channel 186 which forms a trough defined by the surface and interior of the first manifold plate 172 as shown by the outermost array of dotted lines in FIG. 1A. Similarly, the first manifold exhaust port 182 is disposed on the front face 184 of the first manifold plate 172 and is adapted to exhaust depressurized or spent fluid. It is further connected to a first manifold exhaust channel 188 which forms a trough defined as shown by the innermost array of dotted lines as shown in FIG. 1A.

The first manifold plate 172 has a centrally disposed bore 190 for receiving the shaft 20 and first fluid monitor passages 192. During operating conditions, the shaft 20 rotates within the bore 190, while the first manifold plate 172 remains stationary and flush with the first valve plate 174. The first fluid monitor passages 192 are connected to the first manifold intake and exhaust channels 186 and 188 and have ports disposed on the front face 184 of the first manifold plate 172. The passages facilitate the measurement of thermodynamic characteristics of the fluid, such as pressure and temperature.

Finally, along with the plurality of bores 48 for receiving the bolts 46 that connect the device 10, the first manifold plate has a plurality of threaded bores 194. The bores 194 receive the first manifold network bolts 196, shown in FIG. 1B, which connect the first manifold plate 172 to the first valve plate 174.

The first valve plate 174 includes a first valve plate intake channel 198 with first valve plate intake ports 200, 202, 204 and 206, and a first valve plate exhaust channel 208 with first valve plate exhaust ports 210, 212, 214 and 216. Spaced about the periphery of the intake and exhaust channels 198 and 208, it further has a centrally disposed bore 218 for receiving the shaft 20 and a plurality of unthreaded bores 220 which are axially aligned with the bores 194 of the first manifold plate 172 and adapted to receive the bolts 196 which connect the first manifold and valve plates 172 and 174 to each other.

Similar to the first manifold plate 172, the first valve plate intake and exhaust channels 198 and 208 are trough shaped. Upon connection of the first manifold and valve plates 172 and 174 they mate respectively with the first manifold intake and exhaust channels 186 and 188 to form first intake and exhaust passages 230 and 232 as shown in FIG. 5.

Figure 3:
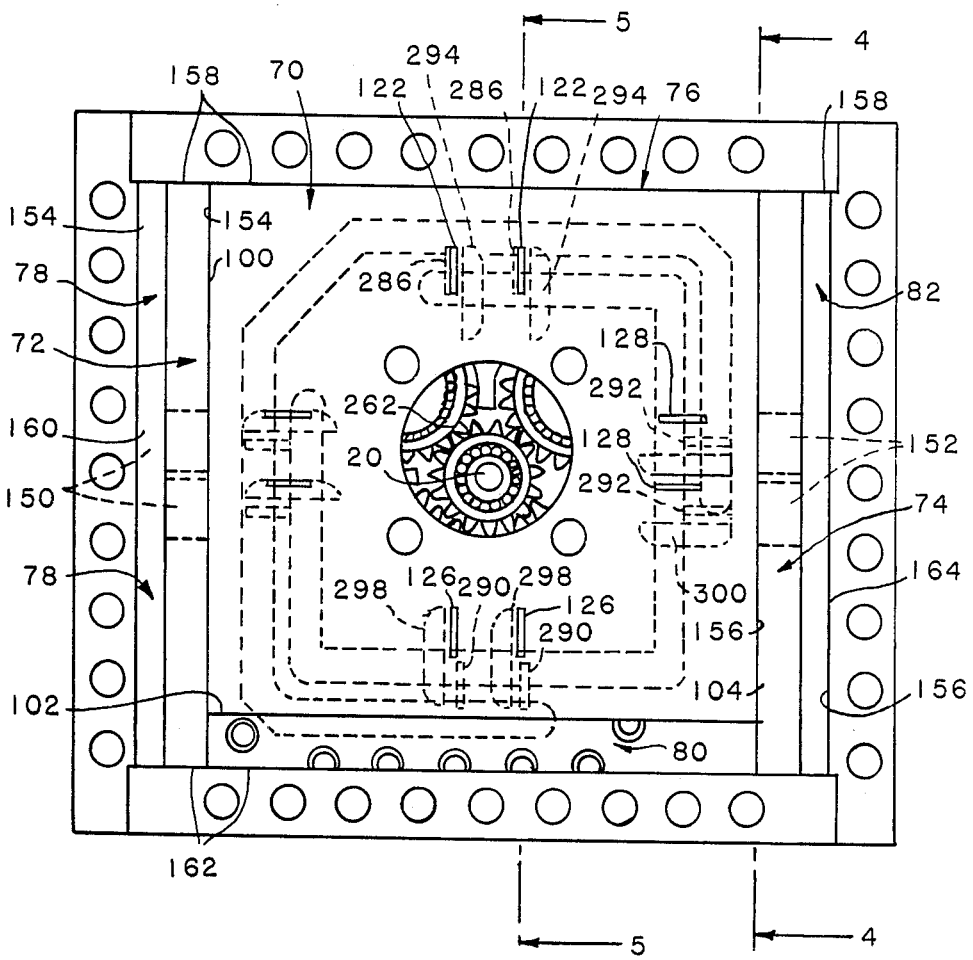
FIG. 3 is a sectional, elevational view of the power conversion device taken as indicated by line 3—3 in FIG. 2.

The first valve plate intake ports 200, 202, 204 and 206 are rectangular. The first valve plate exhaust ports 210, 212, 214 and 216 are elongated with one flat side and one side having rounded ends as shown in FIG. 3, the short port shape being particularly advantageous because it permits rapid fluid flow, or alternatively rapid termination of fluid flow, through the fluid passages 110, 112, 114 and 116. The intake and exhaust ports 200, 202, 204, 206 and 210, 212, 214 and 216 are kept as small as possible in order to maintain enthalpy. As illustrated in FIG. 1B, there are advantageously four sets of first valve plate intake and exhaust ports. It will, however, be appreciated that additional fluid passages may be added. Each set is oriented on a specific portion of the first valve plate 174 which alternately brings the intake and exhaust ports of the set into alignments with their corresponding fluid ports 122, 124, 126 and 128 of the fluid passages 110, 112, 114 and 116 during selected stages of the orbit of the first piston plate 70.

More particularly, the first valve plate intake ports 200, 202, 204 and 206 first accept pressurized fluid that has been injected into the first intake passage 230 through the first manifold intake port 180. Thereafter, during the orbit of the first piston plate 70, the fluid ports 122, 124, 126 and 128 of the fluid passages 110, 112, 114 and 116 of the first piston plate are sequentially aligned respectively with the first valve plate intake ports 200, 202, 204 and 206. During such periods of alignment the intake ports 200, 202, 204 and 206 direct pressurized fluid through their corresponding fluid passages 110, 112, 114 and 116, which in turn direct pressurized fluid to their corresponding first pressure chambers 76, 78, 80 and 82.

Conversely, when the orbit of the first piston plate 70 brings the first valve plate exhaust ports 210, 212, 214 and 216 into sequential alignment with their corresponding fluid ports 122, 124, 126 and 128 of the fluid passages, 110, 112, 114 and 116, the exhaust ports 210, 212, 214 and 216 receive depressurized or spent fluid from the first pressure chambers 76, 78, 80 and 82. The spent fluid is then transferred to the first exhaust passages 232, where it is exhausted through the first manifold exhaust port 182.

The sequential alignments of fluid flow by the first valve plate intake and exhaust ports 200, 202, 204 and 206 and 210, 212, 214 and 216 in cooperation with their corresponding fluid passages 110, 112, 114 and 116, therefore, occur in a sequence and cycle which corresponds to the sequential and cyclical pressurization and depressurization of the first chambers 76, 78, 80 and 82. The following table illustrates the four-part sequence:

| PRESSURIZATION | DEPRESSURIZATION | ALIGNMENT |
|---|---|---|
| first chamber 76 | first chamber 80 | intake ports 200 align with fluid ports 122 of the fluid passage 110; exhaust ports 214 align with fluid ports 126 of the fluid passage 114 |
| first chamber 78 | first chamber 82 | intake ports 202 align with fluid ports 124 of the fluid passage 112; exhaust ports 216 align with fluid ports 128 of the fluid passage 116 |
| first chamber 80 | first chamber 76 | intake ports 204 align with fluid ports 126 of the fluid passage 114; exhaust ports 210 align with fluid ports 122 of the fluid passage 110 |
| first chamber 82 | first chamber 78 | intake ports 206 align with fluid ports 128 of the fluid passage 116; exhaust ports 212 align with fluid ports 124 of the fluid passage 112 |

The second manifold network 30 is similar to the first manifold network 40, but that, as discussed below, it serves as a valve system for both the first and second piston assemblies 16 and 18 and has a set of four bores 236 for the gear assembly 24.

Similar to the first manifold network 40, the second manifold network 30 has second manifold and valve plates 240 and 242 which regulate the supply of pressurized fluid to, and the exhausting of depressurized or spent fluid from, the first chambers 76, 78, 80 and 82. However, this regulation occurs from the side of the first piston plate 70 corresponding to the piston plate face 96, while the regulation performed by the first manifold network 40 occurs with respect to the piston plate face 94.

As shown in FIGS. 1E and 5, the second manifold plate 240 includes intake and exhaust ports 244 and 246, disposed respectively on the elongated edges 248 and 250. The second manifold intake and exhaust ports 244 and 246 are further connected respectively to second manifold intake and exhaust channels 252 and 254 which form troughs.

The central portion of the second manifold plate 240 also defines a central bore 256 which is adapted to receive the shaft 20 and its surrounding drive gear 258. However, unlike the centrally disposed bore 190 of the first manifold plate, the central bore 256 is surrounded by the four bores 236 which are in turn surrounded by the second manifold intake and exhaust channels 252 and 254. Each bore 236 is adapted to receive a separate timing pin 260 and its surrounding timing gear 262. Lubrication channels 264 with openings disposed on elogated edges 266 and 268 and abutting their corresponding bores 236 may also be provided for the purpose of lubricating them.

Spaced about the periphery of the second manifold intake and exhaust channels 252 and 254, the second manifold plate also has a plurality of threaded bores 270. The bores 270 are adapted to receive the bolts 272, shown in FIG. 1D, which connect the second manifold and valve plates 240 and 242.

Unlike the first manifold plate 172, the second manifold plate 240 includes an additional set of fluid intake and exhaust channels 252' and 254', shown in FIG. 5, which are connected respectively to the second manifold intake and exhaust ports 244 and 246. As described below, the channels 252' and 254' mate with a second valve plate 242' of the second manifold network 30, thereby forming a valve system relative to the inner face 280 of the second piston plate 170, as shown in FIG. 4.

The second valve plate 242 is essentially similar to the first valve plate 174. As shown in FIGS. 1D and 3, it includes second valve plate intake and exhaust channels 282 and 284 with second valve plate intake ports 286, 288, 290, and 292 respectively and second valve plate exhaust ports 294, 296, 298 and 300 respectively. Spaced about the periphery of the channels 282 and 284 is a plurality of unthreaded second valve plate bores 302 with counterbores 304 that have greater diameters than the bores 302. The bores 302 are coaxially alignable with the threaded bolt bores 270 of the second manifold plate 240 and receive the second valve plate bolts 272 which connect the second manifold plate 240 to the second valve plate 242.

As shown in FIG. 5, when the second manifold network 30 is assembled, the second valve plate intake and exhaust channels 282 and 284 mate respectively with the second manifold intake and exhaust channels 252 and 254 to form respectively second fluid intake and exhaust passages 306 and 308. The assembly then functions in a manner similar to that described for the first manifold network.

The second valve plate 242 further includes a centrally disposed bore 310 for receiving the drive shaft 20. Unlike the first valve plate 174, however, it advantageously has four bores 312 for receiving the timing pins 260 and their surrounding timing gears 262. Upon assembly, the bores 312 mate with the bores 236 of the second manifold plate 240.

The second manifold network 30 also functions as a valve system for the second piston assembly 18 and flushly abuts the inner face 34 of the second housing 14, as shown in FIG. 4. It includes the second manifold plate 240 and second valve plate 242'. The second valve plate 242', shown in FIGS. 4 and 5, is similar to the second valve plate 242, shown in FIG. 1D, and mates with the face (not shown) of the second manifold plate 240 that faces toward the inner face 34 of the second housing 14.

Accordingly, and as shown in FIGS. 4 and 5, upon assembly of the second manifold and valve plates 240' and 242', the second manifold intake and exhaust channels 252' and 254' cooperate with second valve plate intake and exhaust channels 282' and 284' to form second fluid intake and exhaust passages 306' and 308'.

It will be appreciated that in the vacuum pump mode of operation the functions of the first manifold intake and exhaust ports 180 and 182, the first valve plate intake and exhaust ports 200, 202, 204 and 206 and 210, 212, 214 and 216, and the first intake and exhaust passages 230 and 232 are reversed. Thus, in the device 10, the first passage 230 will then operate as a conduit which receives pressurized fluid from the first valve plate ports 200, 202, 204 and 206 and conveys the fluid through the first manifold port 180.

Correspondingly, the functions of the second manifold intake and exhaust ports 244 and 246, the second valve plate intake and exhaust ports 286, 288, 290 and 292 and 294, 296, 298 and 300 and the second intake and exhaust passages 306 and 308 are reversed. Thus, in the device 10, the second passage 306 will then operate as a conduit which receives pressurized fluid from the second valve plate ports and conveys the fluid through the second manifold port 244.

Figure 6:
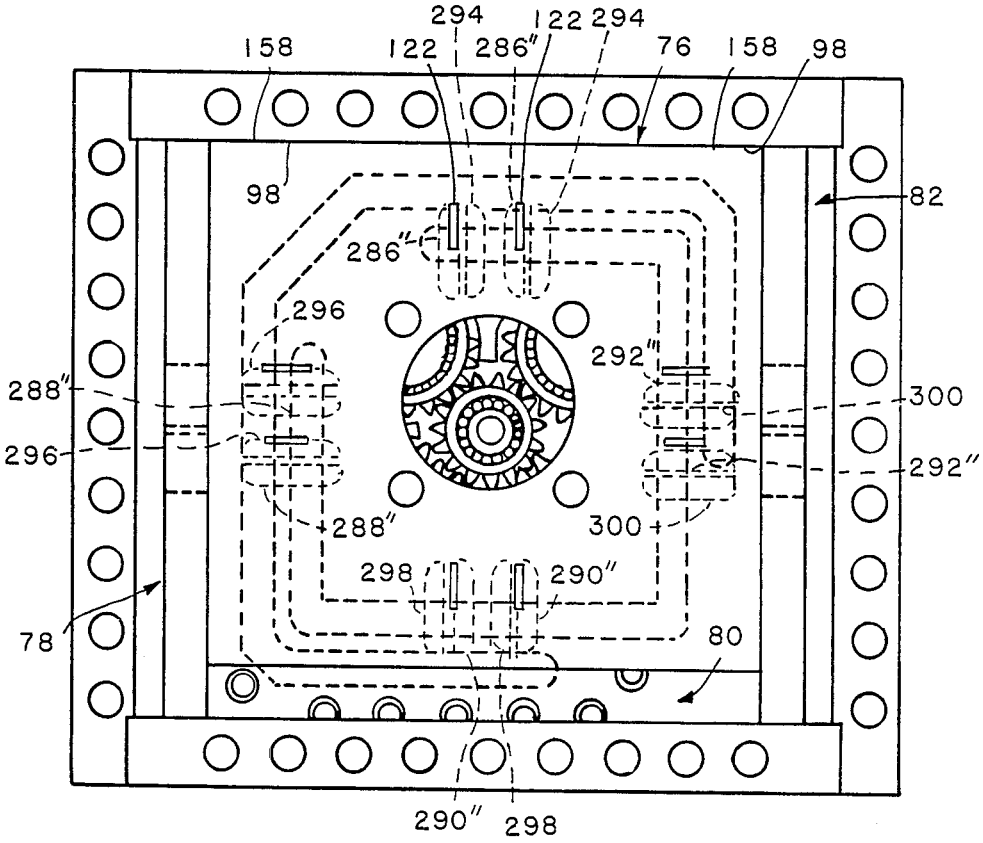
FIG. 6 is a sectional, elevational view of an alternative embodiment of a valve system for a power conversion device to be used with a liquid, the view being taken as indicated by line 3—3 in FIG. 2.

If the power conversion device of the present invention is to be used with a liquid rather than a compressible gas, the shapes of first and second valve plate intake and exhaust ports may both be elongated with one flat side and one side having rounded ends as shown in FIG. 6. This difference may be observed by comparing the device 10 of FIG. 6, which may function as a liquid motor or pump, with the otherwise similar device of FIG. 3 for use with a compresible gas. Thus, in FIG. 6 the second valve plate intake ports 286'', 288'', 290'', and 292'' have the shape described above.

In accordance with a further aspect of the invention the gear assembly 24 includes the shaft 20 with the drive gear 258 mounted on an intermediate part of the shaft and a transmission gear 320 attached near the end 322 of the shaft 20. The drive gear 258 is advantageously engageable with the four timing gears 262 which are attached to the timing pins 260 in offset fashion. (See FIG 1E.) The timing pins 260 and the shaft 20 may be surrounded respectively by friction reduction bearings 324 and 326 which reduce friction during operating conditions.

It has been found that best results are obtained when four timing gears 262 are used which are disposed approximately 90 degrees apart with respect to a transverse axis of the drive shaft as shown in FIG. 1E. Alternatively, a less-preferred arrangement with only two timing gears 262 with corresponding timing pins 260 may be employed. In that event, the timing gears are advantageously disposed diametrically opposite to one another.

A substantial part of the device 10, such as the piston plates and their accompanying two piston sliders, is advantageously made from, preferably molded, plastic. Consequently, the device 10 is more lightweight and less expensive to manufacture.

The operation of the device 10 will now be described. Although the discussion below will focus primarily on the operation of the first and second manifold networks 40 and 30 in conjunction with the first piston assembly 16, it will be appreciated that the operation of the second and third manifold networks 30 and 42 in conjunction with the second piston assembly 18 is essentially similar.

Considering now the operation of the device 10 in the engine mode, the operation may be described in terms of a repeating cycle comprised of four stages of counterclockwise orbital movement of the first piston plate 70.

As the first stage begins, the first piston plate 70 and two first sliders 72 and 74 are positioned such that the first and second valve plate intake ports 200 and 286 of respectively the first and second valve plates 174 and 242 are aligned respectively with the fluid ports 122 of the fluid passages 110. Concurrently, the first and second valve plate exhaust ports 214 and 298 are aligned respectively with the fluid ports 126. Moreover, first elongated edges 154 and 156 of the two first piston sliders 72 and 74 and the plate faces 94 and 96 of the first piston plate 70 close off any fluid existing in the first chambers 78 and 82 respectively. Pressurized fluid then substantially simultaneously enters the first and second valve plate intake ports 200 and 286 from the first and second intake passages 230 and 306. Conversely, depressurized fluid simultaneously exits the fluid ports 126 from the first fluid passage 114 and enters the first and second valve plate exhaust ports 214 and 298.

As such, pressurized fluid simultaneously enters the fluid ports 122 of the fluid passage 110 from the first and second valve plate intake ports 200 and 286 respectively. The fluid then flows through the first passage 110 which redirects the fluid, through the elongated edge ports 130 of the fluid passage 110, thereby supplying pressurized fluid to the first chamber 76.

This initial pressurization of the first chamber 76 results in the pressurized fluid within the first chamber 76 directing the first piston plate 70 away from the longitudinal edge 158 of the first housing 12, imparting a counterclockwise angular momentum to the first piston plate 70 and initiating its orbit about the shaft 20. As a result, the volume of the first chamber 76 increases, while that of the first chamber 80 decreases. Concurrently with the initial pressurization, the momentum of the first plate 70 forces the two first piston sliders 72 and 74 to move from right to left (when viewed relative to the face 94 of the first plate 70). Consequently the first slider 72 decreases the volume of the first chamber 78 by moving toward the longitudinal edge 160 of the first housing 12, while the first slider 74 increases the volume of first chamber 82 by moving away from the longitudinal edge 164 of the first housing 12.

At the same time, any depressurized or energy-spent fluid remaining from a previous cycle within the first chamber 80 is exhausted from it through the first and second exhaust passages 232 and 308. This depressurization of the first chamber 80 facilitates the counterclockwise orbital movement of the first plate 70 by creating a pressure drop in the first chamber 80. More specifically, as the first stage begins the two piston plate faces 94 and 96 cease to close off the fluid with the first chamber 80. As a result, a pressure differential is created which causes the fluid within the first chamber 80 to enter the fluid passage 114 through the elongated edge ports 134. The fluid passage 114 then redirects the spent fluid and exhausts it through the fluid ports 126 of the fluid passage 114 which direct the spent fluid through the first and second valve plate exhaust ports 214 and 298 and thereupon into the first and second exhaust passages 232 and 308.

As the first stage of the counterclockwise orbit of the first piston plate 70 continues, the supply of pressurized fluid continues and the first plate 70 begins to slide downwardly relative to the first piston sliders 72 and 74, the bolts 142 connecting the first plate 70 to the first piston sliders 72 and 74 moving within the counterbores 146. The two first piston sliders 72 and 74 also continue their leftward movement. Consequentially, more and more of the pressurized fluid in the first chamber 76 is expanded and depressurized through conversion of its energy into the orbital movement of the first piston plate 70.

As the first stage of the counterclockwise orbit of the first piston plate 70 ends, the supply of pressurized fluid to the first chamber 76 is terminated by virtue of the piston plate faces 94 and 96 closing off the supply of pressurized fluid from the first and second valve plate intake ports 200 and 286 respectively. Concurrently, the piston plate faces 94 and 96 also close off the exhausting of the spent fluid in the first chamber 80 through the first and second valve plate exhaust ports 214 and 298. The first piston sliders 72 and 74 also temporarily stop moving while the first piston plate 70 continues to slide downward relative to them.

As the second stage begins, the two first sliders 72 and 74 begin rightward movement (when viewed relative to the face 94 of the first plate 70) and the first piston plate 70 continues to slide downward and orbit about the shaft 20. These movements align the first and second valve plate intake ports 202 and 288 of, respectively, the first and second valve plates 174 and 242 with the fluid ports 124 of the fluid passages 112. The elongated edge ports 132 of the fluid passage 112 align with the slider ports 150 of the first piston slider 72. concurrently, the first and second valve plate exhaust ports 216 and 300 are aligned respectively with the fluid ports 128 of the fluid passage 116, while the elongated edge ports 136 of the fluid passage 116 align with the first slider ports 152 of the first piston slider 74. Moreover, the piston plate faces 94 and 96 seal off any fluid in the first chambers 76 and 80 by covering the first valve plate fluid intake and exhaust ports 200, 204, 210 and 214 and the second valve plate fluid intake and exhaust ports 286, 290, 294 and 298.

As such, pressurized fluid simultaneously enters the fluid ports 124 of the fluid passage 112 from the first and second valve plate intake ports 202 and 288 respectively. The fluid then flows through the fluid passage 112 which redirects the fluid through the elongated edge ports 132 and the slider ports 150, thereby supplying pressurized fluid to the first chamber 78. Accordingly, the fluid in the first chamber 78 imparts further counterclockwise angular momentum to the first piston plate 70 and left to right movement to the first piston sliders 72 and 74. As a result, the volume of first chambers 76 and 78 increases, while that of first chambers 80 and 82 decreases.

At the same time, any energy-spent fluid, remaining from a previous cycle, with the first chamber 82 is exhausted from it through the first and second exhaust passages 232 and 308. The depressurization of the first chamber 82 facilitates the counterclockwise orbital movement of the first plate 70 by creating a pressure drop in the first chamber 82. More specifically, as the second stage begins the two piston plate faces 94 and 96 cease to seal off the fluid within the first chamber 82 from the fluid passage 128. As a result, a pressure differential ensues which causes the fluid within the first chamber 82 to enter the fluid passage 128. The fluid first proceeds through the slider ports 152 of the first piston slider 74 and the elongated edge ports 136 which have become aligned with the slider ports 152. The fluid passage 116 then redirects the spent fluid and exhausts it through the fluid ports 128 of the first passage 116 which direct the spent fluid through the first and second valve plate exhaust ports 216 and 300.

As a secondary stage of the orbit of the first plate 70 ends, the supply of pressurized fluid from the first and second valve plate intake ports 202 and 288 to the first chamber 78 is terminated by virtue of the fluid ports 124 of the fluid passages 112 becoming non-aligned with the first and second valve plate intake ports 202 and 288. As such, the piston plate faces 94 and 96 close off the supply of pressurized fluid to the first chamber 78 through the fluid ports 124. The elongated edge 154 of the first slider 72 and the elongated edge 100 of the first plate 70 also cooperate to close off fluid with the first chamber 78. At the same time, the fluid ports 128 of the fluid passages 116 become non-aligned with the first and second valve plate exhaust ports 216 and 300. As such, the piston plate faces 94 and 96 close off the exhausting of depressurized fluid from the first chamber 82 through the fluid ports 128. The elongated edge 104 of the first plate 70 and the elongated edge 156 of the first slider 74 also cooperate to close off any residual spent fluid within the first chamber 82.

The third stage of orbit is analogous to that of the first stage, except that during the third stage first chamber 80 is now pressurized and first chamber 76 depressurized. It begins with the first and second valve plate intake ports 204 and 290 becoming aligned with the fluid ports 126. Concurrently, the first and second valve plate exhaust ports 210 and 294 are aligned with the fluid ports 122. Moreover, the elongated edges 154 and 156 and the plate faces 94 and 96 seal off any fluid existing in the first chambers 78 and 82 respectively.

As such, pressurized fluid simultaneously enters the fluid ports 126 of the fluid passage 114 from the first and second valve plate intake ports 204 and 290 corresponding respectively to the first and second intake passages 230 and 306. The fluid then flows through the fluid passage 114 which redirects the fluid through the elongated edge ports 134 of the fluid passage 114, thereby supplying pressurized fluid to the first chamber 80.

This initial pressurization of the first chamber 80 results in the pressurized fluid within the first chamber 80 directing the first piston plate 70 upward and away from the longitudinal edge 162 of the first housing 12, imparting further counterclockwise angular momentum to the first plate 70 and continuing its orbit about the shaft 20. As a result, the volume of the first chamber 80 increases, while that of the first chamber 76 decreases. Concurrently with the pressurization, the momentum of the first plate 70 forces the two first piston sliders 72 and 74 to continue to move from left to right. Consequently the first slider 74 decreases the volume of the first chamber 82 by moving toward the longitudinal edge 164 of the first housing 12, while the first slider 72 increases the volume of first chamber 78 by moving away from the longitudinal edge 160 of the first housing 12.

At the same time, the depressurized or energy-spent fluid, within the first chamber 76 is exhausted from it through the first and second exhaust passages 232 and 308. This depressurization of the first chamber 76 facilitates the counterclockwise orbital movement of the first plate 70 by creating a pressure drop in the first chamber 76. More specifically, as the third stage begins the two piston plate faces 94 and 96 cease to close off any fluid within the first chamber 76. As a result, a pressure differential is created which causes the fluid within the first chamber 76 to enter the fluid passage 110 through the elongated edge ports 130. The fluid passage 110 then redirects the spent fluid and exhausts it through the fluid ports 122 of the fluid passage 110 which direct the spent fluid through the first and second valve plate exhaust ports 210 and 294 and thereupon through the first and second exhaust passages 232 and 308.

As the third stage of the counterclockwise orbit of the first piston plate 70 continues, the supply of pressurized fluid continues and the first plate 70 slides upward relative to the first piston sliders 72 and 74, the bolts 142 connecting the first plate 70 to the first piston sliders 72 and 74 moving within the counterbores 146. The two first piston sliders 72 and 74 also continue their rightward transverse movement. Consequently, more and more of the pressurized fluid in the first chamber 80 is expanded and depressurized through conversion of its energy into the orbital movement of the first piston plate 70.

As the third stage of the counterclockwise orbit of the first piston plate 70 ends, the supply of pressurized fluid to the first chamber 80 is terminated by virtue of the two piston plate faces 94 and 96 closing off the supply of pressurized fluid from the first and second valve plate intake ports 204 and 290 respectively. Concurrently, the first piston plate faces 94 and 96 also seal off the exhausting of the spent fluid in the first chamber 76 through the first and second valve plate exhaust ports 210 and 294. The first piston sliders 72 and 74 also temporarily stop moving while the first piston plate 70 continues to slide upward relative to the first piston sliders 72 and 74.

The fourth stage of the orbit is analogous to that of the second stage, except that during the fourth stage the first chamber 82 is now pressurized and the first chamber 78 depressurized. As the fourth stage begins, the two first sliders 72 and 74 begin leftward, transverse movement and the first piston plate 70 continues to slide upward and orbit about the shaft 20. These movements align the first and second valve plate intake ports 206 and 292 of respectively the first and second valve plates 174 and 242 with the fluid ports 128 of the fluid passages 116. The elongated edge ports 136 of the fluid passage 128 align with the slider ports 152 of the first piston slider 74. Concurrently, the first and second valve plate exhaust ports 212 and 296 are aligned respectively with the fluid ports 124 of the fluid passage 112, while the elongated edge ports 132 of the fluid passage 124 align with the slider ports 150 of the first piston slider 72. Moreover, the piston plate faces 94 and 96 seal off any fluid in the first chambers 76 and 80 by covering the first valve plate fluid intake and exhaust ports 200, 204, 210 and 214 and the second valve plate fluid intake and exhaust ports 286, 290, 294 and 298.

As such, pressurized fluid simultaneously enters the fluid ports 128 of the fluid passage 116 from the first and second valve plate intake ports 206 and 292 respectively. The fluid then flows through the fluid passage 82 which redirects the fluid through the elongated edge ports 136 and the slider ports 152, thereby supplying pressurized fluid to the first chamber 82. Accordingly, the fluid in the first chamber 82 imparts further counterclockwise angular momentum to the first piston plate 70 and right to left movement to the first piston sliders 72 and 74. As a result, the volume of first chambers 80 and 82 increases, while that of first chambers 76 and 78 decreases.

At the same time, any energy-spent fluid, within the first chamber 78 is exhausted from it through the first and second exhaust passages 232 and 308. The depressurization of the first chamber 78 facilitates the counterclockwise orbital movement of the first plate 70 by creating a pressure drop in the first chamber 78. More specifically, as the fourth stage begins the two piston plate faces 94 and 96 cease to seal off the fluid within the first chamber 78 from the fluid passage 112. As a result, a pressure differential ensues which causes the fluid within the first chamber 78 to enter the fluid passage 112. The fluid first proceeds through the slider ports 150 of the first slider and the elongated edge ports 132 which have become aligned with the slider ports 150. The fluid passage 112 then redirects the spent fluid and exhausts it through the fluid ports 124 of the fluid passage 112 which direct the spent fluid through the first and second valve plate exhaust ports 212 and 296.

As a fourth stage of the orbit of the first plate 70 ends, the supply of pressurized fluid from the first and second valve plate intake ports 206 and 292 to the first chamber 82 is terminated by virtue of the fluid ports 128 of the fluid passages 116 becoming non-aligned with the first and second valve plate intake ports 206 and 292. As such, the piston plate faces 94 and 96 close off the supply of pressurized fluid to the first chamber 82 through the fluid ports 128. The elongated edge 104 of the first plate 70 and the elongated edge 156 of the first slider 74 also cooperate to close off fluid within the first chamber 82. At the same time, the fluid ports 124 of the fluid passage 112 become non-aligned with the first and valve plate exhaust ports 212 and 296. As such, the piston plate faces 94 and 96 close off the exhausting of depressurized fluid from the first chamber 78 through the fluid ports 124. The elongated edge 100 of the first plate 70 and the elongated edge 154 of the first slider 72 cooperate to close off any residual spent fluid with the first chamber 78. The conclusion of the fourth stage also returns the first piston plate to the first stage where the cycle begins again.

The counterclockwise angular momentum of the first piston plate 70, as described above, in response to the sequential pressurization and depressurization of the first chambers 76, 78, 80 and 82 drives the shaft 20 and gear assembly 24. As a result, fluid pressure is converted into rotary motion of the shaft.

Figure 7:
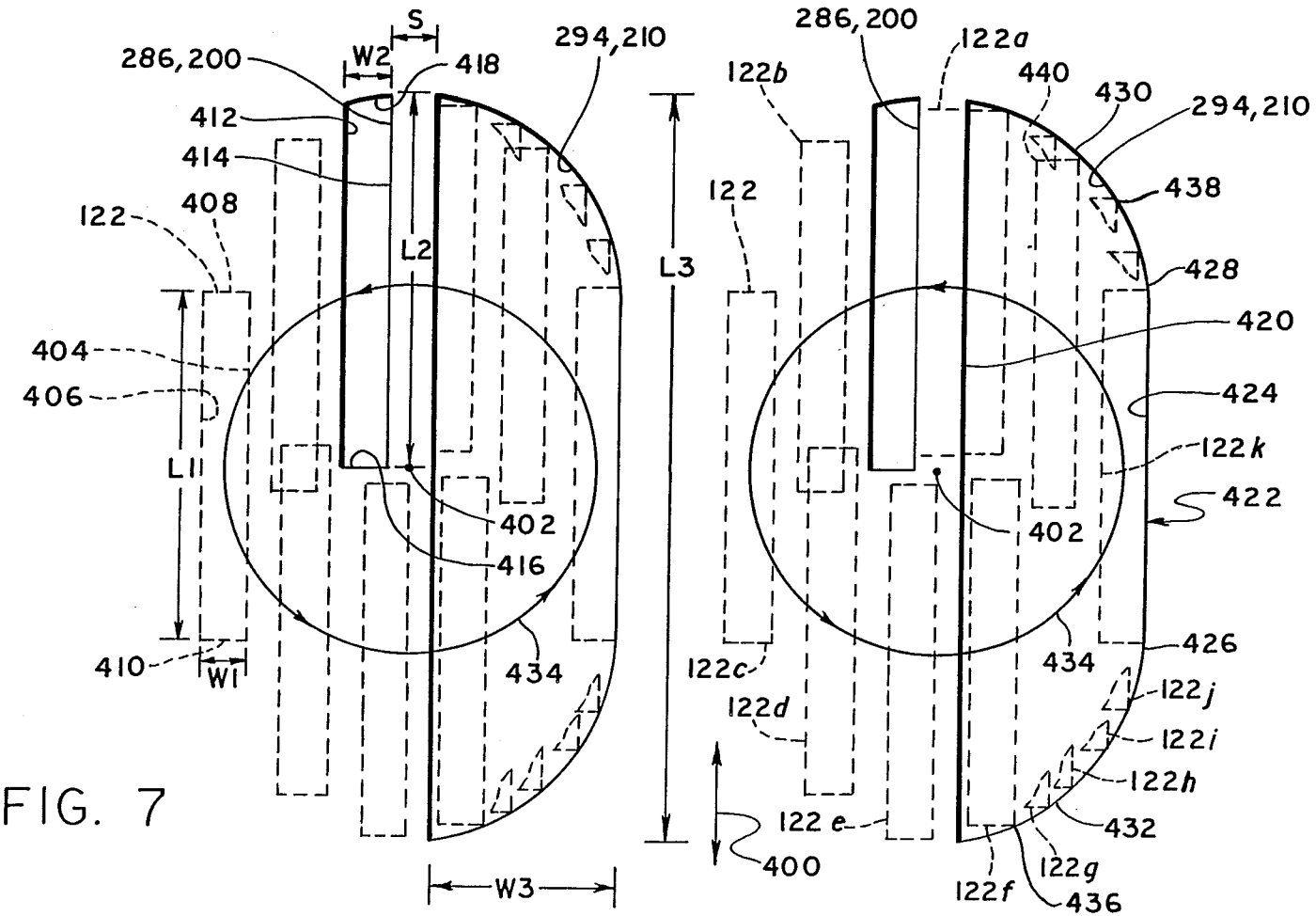
FIG. 7 is an enlarged representation of some of the valving ports for controlling the delivery of pressure fluid to and from one of the pressure chambers in the FIGS. 1 to 5 form of the invention.

To facilitate a full understanding of the timed valving action of piston plate 70 in controlling the delivery of pressure fluid to and from the various pressure chambers 76, 78, 80 and 82, FIG. 7 illustrates in greatly enlarged form the valving ports associated with one of those chambers, specifically the upper chamber 76 of FIG. 3. FIG. 7 shows these valving ports essentially as seen in the upper portion of FIG. 3, except that in FIG. 7 the fluid inlet ports 200 and 286 and fluid outlet ports 210 and 294 in the side wall structures are shown in full lines rather than in the broken lines of FIG. 3, while various positions of the ports 122 in opposite sides of piston plate 70 are shown in broken lines in FIG. 7.

To assist in describing the shapes and orientation of these ports relative to the chamber 76 for which they control admission and discharge of fluid, the arrow 400 is provided in FIG. 7 as a representation of the direction in which the associated chamber 76 varies in size, that is, upwardly and downwardly as viewed in FIGS. 3 and 7. As piston plate 70 moves downwardly relative to piston slider elements 72 and 74 and the outer housing of the device, chamber 76 progressively increases in vertical dimenstion, and as the piston 70 subsequently moves upwardly relative to the other parts the vertical dimension of chamber 76 decreases.

For an optimum valving action, it is desirable that all of the valving ports 200, 286, 210, 294, an 122 be elongated in this direction in which the corresponding chamber 76 varies in size during operation of the device. Preferably, each of these ports has a length dimension in the specified direction at least about three times its transverse width dimension. For example, the length dimension L1 of ports 122 in the opposite sides of piston plate 70 should be at least about three times the width dimension W1 of those ports, the length dimension L2 of ports 200 and 286 should be at least three times their width dimension W2, and the length dimension L3 of ports 210 and 294 should be at least three times the width dimension W3 of those ports. Also, the ports 210 and 294 which function as outlet ports when the device is operating as a fluid driven motor should have larger dimensions than the other valving ports. That is, the length L3 of each of the ports 210 and 294 should be substantially greater than, preferably about twice as great as, the length L1 of ports 122 and the length L2 of ports 286 and 200. Similarly, the width W3 of each of the ports 294 and 210 should be substantially greater than, and preferably at least about three times as great as, the width W1 of ports 122 and the width W2 of ports 286 and 200. Further, the overall area of each of the ports 294 and 210 should be substantially greater than, and preferably at least about four times as great as, the area of each of the ports 122, 286 and 200.

In the preferred arrangement illustrated in FIG. 7, the ports 122 in the opposite sides of piston plate 70 are rectangular in shape, being defined by two parallel opposite side edges 404 and 406 extending in the direction in which chamber 76 varies in size, as represented by the arrow 400, and two parallel opposite end edges 408 and 410 extending perpendicular to edges 404 and 406. Ports 286 and 200 are generally rectangular in configuration, and have parallel opposite side edges 412 and 414 extending parallel to the arrow 400 representing the direction in which chamber 76 varies in size. At its lower end, each of the ports 286 and 200 has an end edge 416 perpendicular to the edges 412 and 414, while at its upper end each port 286 and 200 is desirably defined by an edge 418 extending arcuately in a manner to be discussed in greater detail at a later point. In many situations, ports 286 and 200 may be of a size approximately the same as ports 122, both in length and width, and therefore area, as illustrated.

Each of the fluid outlet ports 294 and 210 desirably has the outline configuration illustrated in FIG. 7, defined by a straight edge 420 at its left side extending parallel to the direction 400 in which chamber 76 varies in size, and by an edge 422 at its right side having a central portion 424 which is straight and parallel to edge 420 between the locations 426 and 428. Above and beneath the locations 428 and 426 respectively, edge 422 has upper and lower arcuately extending portions 430 and 432 curving progressively leftwardly and toward the upper and lower ends of the left edge 420 of ports 294 and 210. Each of the ports 286 and 200 is laterally opposite the upper portion of a corresponding one of the ports 294 or 210, so that the upper extremity 418 of each port 286 or 200 is essentially directly opposite the upper end of the corresponding port 294 or 210, while the lower extremities 416 of the ports 286 and 200 are laterally opposite vertically intermediate portions of ports 294 and 210, preferably opposite the center of the vertical extent of ports 294 and 210. The lateral spacing S between each of the ports 286 or 200 and the adjacent port 294 or 210 should be at least as great as, and preferably substantially equal to, the width dimension W1 of ports 122.

The circles 434 of FIG. 7 represent the path of orbital movement followed by the center of each of the ports 122 about axis 402 as the piston plate which carries ports 122 moves orbitally about that axis. A series of the different positions of ports 122 relative to the stationary ports are represented at 122*a*, 122*b*, 122*c*, etc.

To describe a cycle of orbital movement of the piston carried ports 122 relative to the stationary ports illustrated in full lines in FIG. 7, assume that ports 122 are initially in the position 122*a* laterally between the upper ends of ports 294/210 and the fluid inlet ports 286/200. As ports 122 move leftwardly from that position 122*a*, the ports 122 move progressively into registry with ports 286 and 200, to admit pressure fluid from the ports 286 and 200 at opposite sides of the piston plate into the ports 122 of the piston plate for delivery to chamber 76. Continued counterclockwise leftward movement causes the ports 122 to move to the position 122*b* laterally beyond ports 286 and 200, to close off further admission of pressure fluid to chamber 76. The pressurized fluid thus trapped within chamber 76 causes expansion of that chamber and downward movement of the piston 70 in FIG. 3. During the remainder of the first half of the cycle of rotary movement of piston plate 70, ports 122 move progressively through the positions 122*c*, 122*d* and 122*e*. Continued counterclockwise movement beyond the position 122*e* brings the ports 122 into registry with the lower portions of ports 294 and 210, as represented by the position 122*f*. From the position 122*f*, the ports 122 advance through a series of positions 122*g*, 122*h*, 122*i* and 122*j*, in which the lower right hand corner 436 of ports 122 moves along an arcuate path corresponding to and coinciding with the arcuate portion 432 of the right hand edge of ports 294 and 210. In an intermediate position 122*k*, the right hand edges 404 of ports 122 coincide with the straight central portion 424 of the right hand edges of ports 294 and 210. Further counterclockwise movement of ports 122 causes their upper right hand corner 438 to follow an arcuate path corresponding to the arcuate curvature of the right hand edge of ports 294 and 210 at 430. The previously mentioned arcuate upper edge 418 of ports 286 and 200 similarly follows the arcuate path of the upper left hand corner 440 of ports 122.

By virtue of the increased size of ports 294 and 210 relative to ports 286, 200 and 122, as previously discussed, the ports 122 remain in full and unrestricted communication with ports 294 and 210 through approximately 180 degrees of the rotary movement of the piston, to allow very free discharge of fluid from the device and thus minimize back pressure and increase operating efficiency. Further, in moving rightwardly from the position 122*e* of FIG. 7, ports 122 are able to very rapidly advance into full registry with discharge ports 294 and 210, to thus open the discharge valves quickly, in a very few degrees of rotary motion of the piston, and maintain that open condition for approximately 180 degrees as mentioned. The ultimate closing of the discharge valve, as ports 122 approach the position 122*a*, is also effected very rapidly and in a minimum number of degrees of rotary motion.

It will be appreciated that in reverse or vacuum pump mode the device 10 simply operates in reverse. More specifically, the shaft 20 imparts clockwise orbital momentum to the first and second piston plates 70 and 170 which sequentially pressurize fluid in selected pressure chambers so as to produce a supply of fluid pressure.

As the first stage begins, the first piston plate 70 and two first piston sliders 72 and 74 are situated such that the first and second valve plate ports 210 and 294 of respectively the first and second valve plates 174 and 242 are aligned respectively with the fluid ports 122 of the fluid passages 110.

Concurrently, the first and second valve plate ports 204 and 290 are aligned respectively with the fluid ports 126 of the fluid passage 114. Moreover, elongated edges 154 and 156 and the piston plate faces 94 and 96 seal off any fluid existing in the first chambers 78 and 82 respectively. As the first piston plate 70 orbits clockwise, a vacuum is created in the first chamber 76 which causes fluid to simultaneously enter the first and second valve plate ports 210 and 294 from the first and second passages 232 and 308. Conversely, fluid pressurized from a previous cycle substantially simultaneously exits the fluid ports 126 from the fluid passage 114 and enters the first and second valve plate ports 204 and 290, thereby supplying pressurized fluid.

As such, the fluid simultaneously enters the fluid ports 122 of the fluid passage 110 from the first and second valve plate ports 210 and 294 respectively. The fluid then flows through the fluid passage 110 which redirects the fluid through the elongated edge port 130 of the fluid passage 110, thereby supplying fluid to the first chamber 76. During the second half of a 360 degree orbit or cycle of the piston plate, the volume of the first chamber 76 decreases, thereby pressurizing the fluid in the first chamber 76.

Near the end of an orbit, the first and second valve plate ports 200 and 286 align with the fluid ports 122 of the fluid passages 110, thereby allowing the pressurized fluid in the first chamber 76 to be vented through the first and second valve plate ports 200 and 286. The pressurized fluid then flows through the first and second passages 230 and 306 and is exhausted from the device through first and second manifold fluid ports 180 and 240. It will be appreciated that pressurized fluid is similarly produced in the first chambers 78, 80 and 82, thereby providing for a supply of pressurized fluid.

It will be further appreciated that the present invention represents an advancement over previous power conversion devices which use reciprocating or non-reciprocating members, or a combination of both, to either irreversibly convert fluid pressure into rotary motion of a drive shaft or irreversibly convert rotary motion of a drive shaft into fluid pressure. It provides a device 10 which is reversible; that is capable of operating both as an engine or as a vacuum pump. The device 10 is also relatively lightweight and not costly to manufacture, since a significant amount of it can be constructed with molded plastic. Its use of only a relatively few moving mechanical parts tends to make the device less prone to premature wear and reduces the need for repair and maintenance. The device's light weight, compactness and economy of moving mechanical parts also permit it to, in engine mode, produce a higher degree of power output per unit weight and to, in reverse or vacuum pump mode, produce a higher degree of fluid pressure per unit weight than previous devices. When used as an engine, it can also accommodate virtually any power source, such as solar panels, that actuates the fluid through heating it or otherwise. Overall, the device 10 is capable of more efficiently converting fluid pressure into rotary motion and vice versa.

Although the invention has been described in detail with reference to the presently preferred embodiments, those of ordinary skill in the art will appreciate that various modifications can be made without departing from the invention. Accordingly, the invention is limited only by the following claims.

I claim:

1. A power conversion unit comprising:

a housing; and a piston assembly contained in said housing and including a piston plate mounted for orbital movement about a first axis, and two additional piston elements at opposite sides of said piston plate mounted to reciprocate in unison along a second axis essentially perpendicular to said first axis in correspondence with a component of said orbital movement;

said piston plate being slidably reciprocable relative to said two additional piston elements essentially perpendicular to said second axis in correspondence with a second component of said orbital movement;

said housing and piston assembly defining fluid chambers at different locations about the piston assembly which vary progressively in size as the piston plate moves orbitally and said additional elements reciprocate;

said two additional piston elements being free of direct rigid attachment to one another, and being retained against movement toward one another by said piston plate therebetween.

2. A power conversion unit as recited in claim 1, in which said additional piston elements have inner surfaces facing inwardly toward said first axis and slidably engaging two peripheral edge surfaces of said piston plate facing radially outwardly away from said first axis.

3. A power conversion unit as recited in claim 1, in which said additional piston elements define inner sides of two of said chambers and contain passages for delivering fluid to and from said two chambers.

4. A power conversion unit as recited in claim 1, in which said piston plate contains passages through which fluid is delivered to and from said chambers.

5. A power conversion unit as recited in claim 1, in which said piston plate contains passages through which fluid is delivered to and from said chambers, said additional piston elements defining inner sides of two of said chambers and containing passages for delivering fluid between said two chambers and some of said passages in the piston plate.

6. A power conversion unit as recited in claim 1, including a shaft, and a drive connection attaching said shaft to said piston plate for rotary movement of the shaft in correspondence with orbital movement of the piston plate.

7. A power conversion unit as recited in claim 6, in which said drive connection includes at least one crank for converting orbital movement of the piston plate to rotation of said shaft.

8. A power conversion unit as recited in claim 6, in which said drive connection includes two similar cranks operatively connected at different locations to said piston plate for rotation of the cranks in correspondence with orbital movement of the piston plate, and three gears turning with said cranks and said shaft respectively and connected operatively together to time the two cranks for rotation in unison with one another and to transmit power between the cranks and shaft.

9. A power conversion unit as recited in claim 1, in which said housing includes two wall structures at opposite axial sides of said piston plate each containing fluid inlet and outlet passages and having inner valving faces with inlet and outlet ports, said piston plate having side faces at its opposite sides adjacent said inner valving faces of said wall structures, and said piston plate containing passages for delivering fluid through the interior of the piston plate between said chambers and said inlet and outlet ports in the two wall structures at both sides of the piston plate.

10. A power conversion unit as recited in claim 7, in which said side faces of said piston plate contain ports communicating with said ports of said wall structure said ports in the piston plate and said inlet and outlet ports of each of said wall structures being each elongated in the direction in which a corresponding one of said chambers varies in size; said inlet and outlet ports in each of said wall structures including, for each of said chambers, a first port in the wall structure having a length dimension, width dimension and area which are greater than the length dimension, width dimension and area respectively of a second port in that wall structure for the same chamber, and also greater than the length dimension, width dimension and area respectively or a corresponding one of said ports in the piston plate.

11. A power conversion unit as recited in claim 10, in which said first port is defined by a first edge which is essentially straight and extends along one side of the port, and a second edge of the port which curves toward the first edge at its opposite ends.

12. A power conversion unit comprising:

a housing; and a piston assembly contained in said housing and including a piston plate mounted for orbital movement about a first axis, two additional piston elements at opposite sides of said piston plate reciprocable along a second axis essentially perpendicular to said first axis in correspondence with a first component of said orbital movement, and two separate sliding connections attaching said two additional piston elements separately to said piston plate for movement of the piston plate and additional piston elements together along said second axis and for simultaneous reciprocating movement of the piston plate relative to said additional piston elements essentially prependicular to said second axis in correspondence with a second component of said orbital movement;

said housing and piston assembly defining together four fluid chambers at opposite sides of said piston plate and at outer sides of said additional piston elements which vary progressively in size as the piston plate moves orbitally and said additional piston elements reciprocate;

said two additional piston elements being unattached to one another except indirectly through said piston plate and said separate sliding connections between the piston plate and the two additional piston elements respectively.

13. A power conversion unit as recited in claim 12, in which each of said separate sliding connections includes means carried by one of said additional piston elements and by an adjacent outer edge portion of said piston plate slidably interfitting independently of the other separate sliding connection in a relation independently retaining said one additional piston element adjacent said outer edge portion of the piston plate while permitting relative sliding movement of the piston plate and said one additional piston element.

14. A power conversion unit as recited in claim 12, in which each of said separate sliding connections includes a pin slidably confined within a slot and retaining a corresponding one of said additional piston elements slidably adjacent an outer edge portion of said piston plate.

15. A power conversion unit as recited in claim 12, in which said piston plate and said additional piston elements contain communicating passages for delivering fluid to and from two of said chambers.

16. A power conversion unit as recited in claim 12, in which said housing includes wall structures at opposite axial side of said piston plate having inner valving faces with inlet and outlet ports adjacent outer surfaces of said piston plate, said piston plate containing passages leading fluid between said chambers and said inlet and outlet ports in the two wall structures at opposite sides of the piston plate.

17. A power conversion unit as recited in claim 16, in which said additional piston elements contain passages communicating with some of said passages in the piston plate for delivering fluid to and from two of said chambers.

18. A power conversion unit as recited in claim 12, including a shaft, and a drive connection attaching said shaft to said piston plate for rotary movement of the shaft in correspondence with orbital movement of the piston plate.

19. A power conversion unit comprising:

a housing; and a piston assembly contained in said housing and including a piston plate mounted for orbital movement about an axis and additional piston means at opposite radially outer sides of said piston plate reciprocable transversely of said axis in correspondence with a component of said orbital movement;

said housing and piston assembly defining together fluid chambers at different locations about the piston assembly each of which varies progressively in size in one direction as the piston plate moves orbitally and said additional piston means reciprocate;

said housing including a wall structure at a side of said piston assembly containing fluid inlet and outlet passages and having an inner face adjacent said piston plate containing valving ports;

said piston plate containing passages communicating with said chambers respectively, and having a side face adjacent said inner face of said wall structure containing ports communicating with said valving ports to alternately admit fluid to and discharge fluid from the chambers through said passages in the piston plate;

said valving ports in said inner face of the wall structure including, for each of said chambers, a first port and a second port one of which is an inlet for supplying fluid to the corresponding chamber and the other of which is an outlet for discharging fluid from the corresponding chamber;

said first valving ports and said second valving ports and said ports in said side face of the piston plate being elongated in essentially the direction in which the corresponding chamber varies in size as said piston plate moves orbitally and said additional piston means reciprocate;

said first ports having a length dimension, in said direction in which the corresponding chamber varies in size, and a width dimension transversely of that direction, and an area, greater than the corresponding length dimension, width dimension and area respectively of said second ports and of said ports in the piston plate.

20. A power conversion unit as recited in claim 19, in which said first and second ports and said ports in the piston plate have length dimensions which are at least about three times their width dimensions.

21. A power conversion unit as recited in claim 19, in which said ports in said piston plate are substantially rectangular.

22. A power conversion unit as recited in claim 19, in which each of said second ports has one end which is essentially laterally opposite a corresponding end of an adjacent first port, and has a second end which is essentially laterally opposite a portion of said adjacent first port intermediate the ends of said adjacent first port.

23. A power conversion unit as recited in claim 19, in which each of said second ports has one end which is essentially laterally opposite a corresponding end of an adjacent first port, and has a second end which is essentially laterally opposite a portion of said adjacent first port near the center of the length of said adjacent first port.

24. A power conversion unit as recited in claim 19, in which one of said first and second ports has an edge at an end thereof which curves essentially along the path followed by an end of one of said ports in the piston plate upon said orbital movement thereof.

25. A power conversion unit as recited in claim 19, in which individual ones of said first ports have edges at opposite ends thereof which curve essentially arcuately along paths followed by opposite ends of a corresponding one of said ports in the piston plate upon said orbital movement thereof.

26. A power conversion unit as recited in claim 19, in which individual ones of said first ports have edges at opposite ends thereof which curve essentially arcuately along paths followed by opposite ends of a corresponding one of said ports in the piston plate upon said orbital movement thereof, and said second ports have edges at one end thereof which extend essentially arcuately along the path followed by ends of said ports in the piston plate upon orbital movement thereof.

27. A power conversion unit as recited in claim 19, in which said second valving ports and said ports in the piston plate have approximately the same length and width dimensions.

28. A power conversion unit as recited in claim 19, in which said ports in the piston plate are essentially rectangular, and individual ones of said first valving ports are defined by a first straight edge extending along one side of the port and a second edge which has a central straight portion and which curves arcuately at its opposite ends toward said first edge and along paths followed by opposite ends of a port in the piston plate upon orbital movement thereof.

29. A power conversion unit as recited in claim 19, in which said ports in the piston plate are essentially rectangular and have a length dimension at least several times as great as their width dimension, said second valving ports being generally rectangular and having length and width dimensions approximately the same as the length and width dimensions of said ports in the piston plate, said first ports having a width dimension several times the width dimensions of said second ports and said ports in the piston plate, each of said second ports having one end which is essentially laterally opposite a corresponding end of an adjacent first port, and having a second end which is essentially laterally opposite a portion of said adjacent first port near the center of the length of said adjacent first port.

30. A power conversion unit as recited in claim 29, in which individual ones of said first valving ports are defined by a first straight edge extending along one side of the port and a second edge which has a central straight portion and which curves arcuately at its opposite ends toward said first edge and along paths followed by opposite ends of a port in the piston plate upon orbital movement thereof.

31. A power conversion unit comprising:

a housing; and a piston assembly contained in said housing and including a piston plate mounted for orbital movement about an axis and additional piston means at opposite radially outer sides of said piston plate reciprocable transversely of said axis in correspondence with a component of said orbital movement;

said housing and piston assembly defining together fluid chambers at different locations about the piston assemby each of which varies progressively in size in one direction as the piston plate moves orbitally and said additional piston means reciprocate;

said housing including two wall structures at opposite sides of said piston assembly each containing fluid inlet and outlet passages and having inner faces adjacent opposite sides of said piston plate respectively containing valving ports;

said piston plate containing passages communicating with said chambers and having opposite side faces adjacent said inner faces of said two wall structures respectively and containing ports communicating with said valving ports to admit fluid to said chambers from opposite sides of the piston plate and discharge fluid from said chambers to opposite sides of the piston plate in timed relation to the orbital movement of the piston plate;

said valving ports in said inner face of each of the wall structures including, for each of said chambers, a first port and a second port one of which is an inlet for supplying fluid to the corresponding chamber and the other of which is an outlet for discharging fluid from the corresponding chamber;

said first valving ports and said second valving ports at both sides of the piston plate and said ports in said opposite side faces of the piston plate each being elongated in essentially the direction in which the corresponding chamber varies in size as said piston plate moves orbitally and said additional piston means reciprocate;

said first ports at both sides of the piston plate having a length dimension, in said direction in which the corresponding chamber varies in size, and a width dimension transversely of that direction, and an area, greater than the corresponding length dimension, width dimension and area respectively of said second ports and of said ports in the piston plate at both sides of the piston plate.

32. A power conversion unit as recited in claim 31, in which said first and second ports and said ports in the piston plate have length dimensions which are at least about three times their width dimensions.

33. A power conversion unit as recited in claim 31, in which said ports in said piston plate are substantially rectangular.

34. A power conversion unit as recited in claim 31, in which each of said second ports has one end which is essentially laterally opposite a corresponding end of an adjacent first port, and has a second end which is essentially laterally opposite a portion of said adjacent first port near the center of the length of said adjacent first port.

35. A power conversion unit as recited in claim 31, in which individual ones of said first ports have edges at opposite ends thereof which curve essentially arcuately along paths followed by opposite ends of a corresponding one of said ports in the piston plate upon said orbital movement thereof.

36. A power conversion unit as recited in claim 31, in which individual ones of said first ports have edges at opposite ends thereof which curve essentially arcuately along paths followed by opposite ends of a corresponding one of said ports in the piston plate upon said orbital movement thereof, and said second ports have edges at one end thereof which extend essentially arcuately along the path followed by ends of said ports in the piston plate upon orbital movement thereof.

37. A power conversion unit as recited in claim 31, in which said second valving ports and said ports in the piston plate have approximately the same length and width dimensions.

38. A power conversion unit as recited in claim 31, in which said ports in the piston plate are essentially rectangular, and individual ones of said first valving ports are defined by a first straight edge extending along one side of the port and a second edge which has a central straight portion and which curves arcuately at its opposite ends toward said first edge and along paths followed by opposite ends of a port in the piston plate upon orbital movement thereof.

39. A power conversion unit as recited in claim 31, in which said ports in the piston plate are essentially rectangular and have a length dimension at least several times as great as their width dimension, said second valving ports being generally rectangular and having length and width dimensions approximately the same as the length and width dimensions of said ports in the piston plate, said first ports having a width dimension several times the width dimensions of said second ports and said ports in the piston plate, each of said second ports having one end which is essentially laterally opposite a corresponding end of an adjacent first port, and having a second end which is essentially laterally opposite a portion of said adjacent first port near the center of the length of said adjacent first port.

40. A power conversion unit as recited in claim 39, to which individual ones of said first valving ports are defined by a first straight edge extending along one side of the port and a second edge which has a central straight portion and which curves arcuately at its opposite ends toward said first edge and along paths followed by opposite ends of a port in the piston plate upon orbital movement thereof.

41. A power conversion unit comprising:

a housing; and a piston assembly contained in said housing and including a piston plate mounted for orbital movement about an axis and additional piston means at opposite radially outer sides of said piston plate reciprocable transversely of said axis in correspondence with a component of said orbital movement;

said housing and piston assembly defining together fluid chambers at different locations about the piston assembly each of which varies progressively in size in one direction as the piston plate moves orbitally and said additional piston means reciprocate;

said housing including a wall structure at a side of said piston assembly containing fluid inlet and outlet passages and having an inner face adjacent said piston plate containing valving ports;

said piston plate containing passages communicating with said chambers respectively, and having a side face adjacent said inner face of said wall structure containing ports communicating with said valving ports to alternately admit fluid to and discharge fluid from said chambers through said passages in the piston plate;

said valving ports in said inner face of the wall structure including, for each of said chambers, a first port and a second port one of which is an inlet for supplying fluid to the corresponding chamber and the other of which is an outlet for discharging fluid from the corresponding chamber;

said first and second valving ports being elongated in essentially the direction in which the corresponding chamber varies in size as said piston plate moves orbitally and said additional piston means reciprocate;

said first ports having a length dimension, in said direction in which the corresponding chamber varies in size, and a width dimension transversely of that direction and an area, greater than the corresponding length dimension, width dimension and area respectively of said second ports.

42. A power conversion unit as recited in claim 41, in which each of said first and second ports has a length dimension at least about three times as great as its width dimension.

43. A power conversion unit as recited in claim 41, in which each of said second ports has one end which is essentially laterally opposite a corresponding end of an adjacent first port, and has a second end which is essentially laterally opposite a portion of said adjacent first port intermediate the ends of said adjacent first port.

44. A power conversion unit as recited in claim 41, in which individual ones of said first ports have edges at opposite ends thereof which curve essentially arcuately along paths followed by opposite ends of a corresponding one of said ports in the piston plate upon said orbital movement thereof.

* * * * *